US007708058B1

(12) United States Patent
Gipson

(10) Patent No.: US 7,708,058 B1
(45) Date of Patent: May 4, 2010

(54) SELECTABLY ELEVATABLE INJECTOR FOR COILED TUBING

(75) Inventor: Tommie Carroll Gipson, Eaton, CO (US)

(73) Assignee: RRI Holdings, Inc., Dallas, TX (US)

( * ) Notice: Subject to any disclaimer, the term of this patent is extended or adjusted under 35 U.S.C. 154(b) by 0 days.

(21) Appl. No.: 12/381,939

(22) Filed: Mar. 18, 2009

(51) Int. Cl.
*E21B 19/22* (2006.01)

(52) U.S. Cl. ..... 166/77.2; 166/77.1; 166/77.3

(58) Field of Classification Search ..... 166/77.1, 166/77.2, 77.3, 162; 242/403, 397.2
See application file for complete search history.

(56) References Cited

U.S. PATENT DOCUMENTS 4,673,035 A * 6/1987 Gipson ..... 166/77.1
5,839,514 A * 11/1998 Gipson ..... 166/384
6,763,890 B2 * 7/2004 Polsky et al. ..... 166/360
7,152,672 B1 * 12/2006 Gipson ..... 166/77.2

* cited by examiner

*Primary Examiner*—Jennifer H Gay
*Assistant Examiner*—Michael Wills, III
(74) *Attorney, Agent, or Firm*—Elizabeth R. Hall

(57) ABSTRACT

A selectably elevatable coiled tubing injector is described that is suitable for a mobile self-contained unitized coil tubing rig for the drilling and workover of petroleum wells. The selectably elevatable coiled tubing injector includes a mechanism for positioning a trailer mounted coiled tubing injector either in a first stowed position on the deck of the transport trailer or in a second position resting on an elevated rig floor of a drilling rig. Furthermore, the selectably elevatable coiled tubing injector includes a further mechanism for selectably elevating the injector above its second position on the rig floor while clamping the tubing in order to provide additional tension on the tubing string or to raise the tubing deployed within a well.

21 Claims, 15 Drawing Sheets

SELECTABLY ELEVATABLE INJECTOR FOR COILED TUBING

BACKGROUND OF THE INVENTION

1. Field of the Invention

The present invention relates to a selectably elevatable coiled tubing injector for a mobile self-contained unitized coil tubing rig for the drilling and workover of petroleum wells. In particular, the present invention concerns a mechanism for positioning a trailer mounted coiled tubing injector either in a first stowed position on the deck of the transport trailer or in a second position resting on an elevated rig floor of a drilling rig.

2. Description of the Related Art

Coiled tubing rigs primarily include a tubing storage reel and a coiled tubing injector for forcing a string of coiled tubing into or pulling it out of a well. Coiled tubing rigs are commonly used in the oilfield for reasons of speed and low cost operation. Due to advances in the ability to run downhole drilling motors on the lower end of a coiled tubing drill string, a need has arisen for coiled tubing injectors which can be positioned on a rig floor so that the tubing from the injector is coaxially aligned with the well bore. Previously, this need has been filled by lifting a self-contained conventional injector from a transport trailer to the rig floor using large forklift trucks, cranes, or other means. Upon completion of a job by such an injector, the injector has to be lifted back onto the transport trailer.

When being transported, such a conventional injector must be restrained by tiedown means, so the conventional approach involves considerable setup and rig down time, as well as necessitating lifting equipment. Additionally, the storage reel must be carefully positioned during the lifting to and from the rig floor in order to avoid damaging the tubing, particularly when the tubing is left engaged with the injector. If the tubing is released from the injector for lifting, then it must be rethreaded through the injector after the injector has been lifted.

Accordingly, a need exists for a coiled tubing injector which can be moved more readily between a transport trailer and a rig floor.

Furthermore, whenever a coiled tubing string is used to drill wells with a downhole motor, the tubing often becomes stuck in the hole due to pressure differentials between the hole and adjacent formations. Whenever this happens, it is necessary to exert considerable upward force on the tubing to free it from the well. Likewise, to retrieve packers from a well and for a variety of other downhole operations, large vertical pulls are needed. These vertical uplift forces are often in excess of what can be provided by the drive means of conventional coiled tubing injectors.

Thus, there is a need for a mechanism that can easily provide additional tension to a coiled tubing string beyond that which can be provided by a conventional coiled tubing injector.

SUMMARY OF THE INVENTION

This invention pertains to a selectably elevatable tubing injector for a mobile self-contained unitized coil tubing rig for the drilling and workover of petroleum wells. In particular, the present invention concerns a mechanism for positioning a trailer mounted coiled tubing injector either in a first stowed position on the deck of the transport trailer or in a second position resting on an elevated rig floor of a drilling rig. Further, the present invention provides a mechanism for selectably elevating the injector above its second position on the rig floor, while clamping onto the tubing, in order to provide additional vertical tension on the tubing string or to raise the tubing deployed within a well.

One embodiment of the present invention includes a positioning mechanism for a trailer mounted coiled tubing injector, the positioning mechanism comprising: (a) a coiled tubing injector support system including an injector cradle providing a framework for mounting the coiled tubing injector, wherein the injector cradle has a cradle opening wherein a portion of a drive wheel of the coiled tubing injector is rotatably housed, a frame assembly having a frame opening, wherein the injector cradle is nested within the frame opening, and a lifting mechanism for selectably elevating and lowering the injector cradle and the coiled tubing injector within the frame opening; (b) a selectably engageable coiled tubing clamp assembly mounted on a first end of the frame assembly; and (c) a swing arm assembly including a plurality of hinged support arms, wherein each support arm is attached at one end to the frame assembly and at a second end to a trailer, and a rotation device that reciprocably rotates the coiled tubing injector support system between a stowed position on the trailer and an operating position.

A second embodiment of the present invention includes a positioning mechanism for a trailer mounted coiled tubing injector system, the positioning mechanism comprising: (a) a coiled tubing injector support system mounted on a trailer, the injector support system including a coiled tubing injector having a rotatable drive wheel and a radially acting coiled tubing hold down mechanism, an injector cradle providing a framework for mounting the coiled tubing injector, wherein the injector cradle has a cradle opening on a top side and wherein a portion of the drive wheel of the coiled tubing injector is rotatably housed and the radially acting coiled tubing hold down mechanism sits above the injector cradle, a frame assembly having a frame opening on a top side, wherein the injector cradle is nested within the frame opening such that the drive wheel of the coiled tubing injector remains rotatable within the injector cradle and the radially acting coiled tubing hold down mechanism sits above the frame assembly, and a lifting mechanism for selectably elevating or lowering the injector cradle and the coiled tubing injector within the frame opening, wherein a first end of the lifting mechanism is attached to the injector cradle and a second end of the lifting mechanism is attached to the frame assembly; (b) a coiled tubing clamp assembly mounted on a first end of the frame assembly, wherein the coiled tubing clamp assembly has two grip blocks for selectably gripping a coiled tubing exiting the coiled tubing hold down mechanism; and (c) a swing arm assembly including a plurality of hinged support arms, wherein each support arm is attached at one end to the frame assembly and at a second end to the trailer, and a rotation device that reciprocably rotates the support arms thereby moving the coiled tubing injector support system into a stowed position on the trailer or to an operating position.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiments disclosed may be readily utilized as a basis for modifying or designing derivative structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
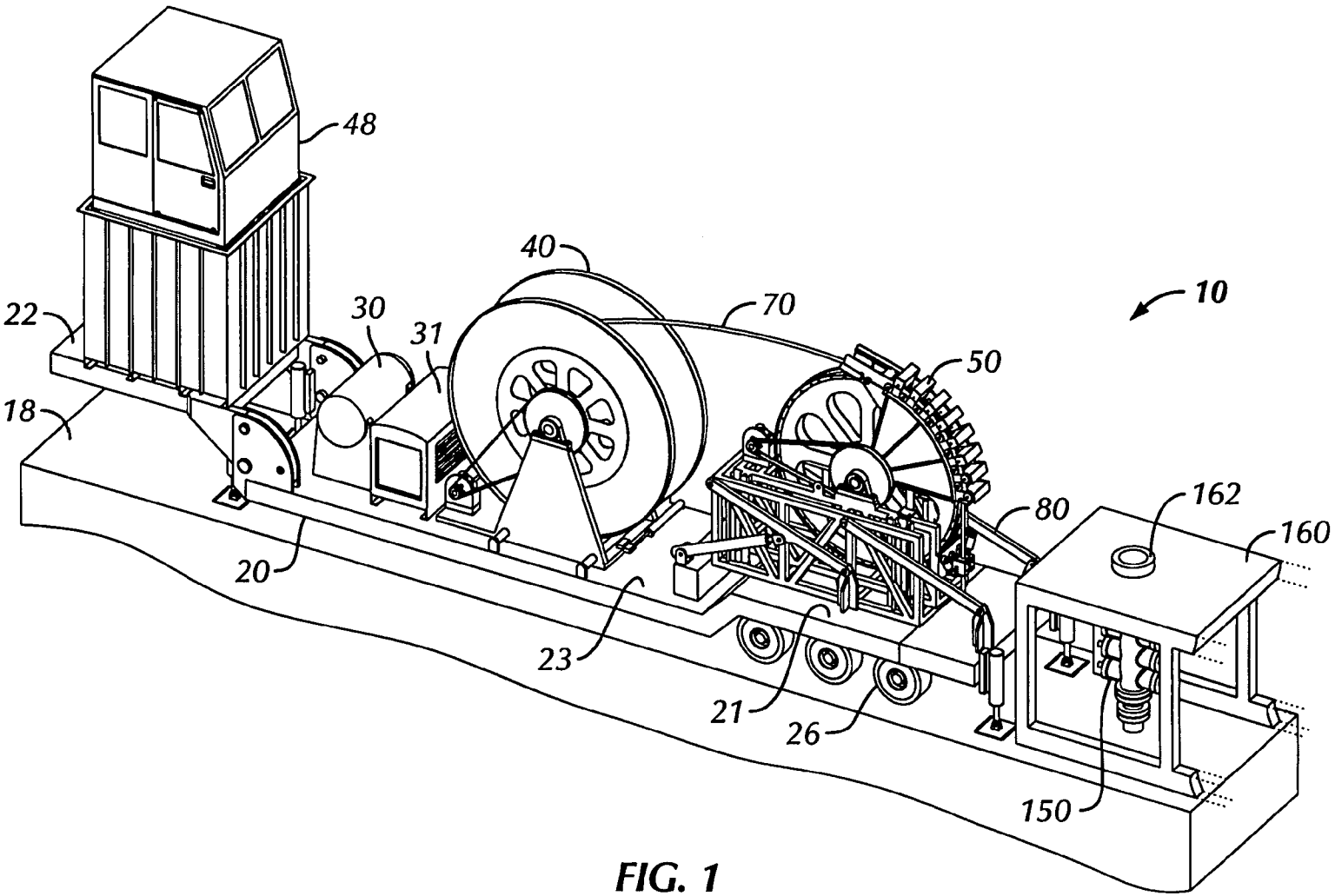
FIG. 1 is an oblique side view of a trailer mounted coiled tubing rig with the selectably elevatable coiled tubing injector.

As a note, the use of the terms "invention", "present invention" and variations thereof throughout the subject patent application (and headings therein) are intended to refer or relate to one or more embodiments of the present application, not necessarily every embodiment or claim of the application.

Referring now to the drawings, it is noted that like reference characters designate like or similar parts throughout the drawings. The figures, or drawings, are not intended to be to scale. For example, purely for the sake of greater clarity in the drawings, wall thicknesses and spacings are not dimensioned as they actually exist in the assembled embodiments.

The structural components of the selectably elevatable coiled tubing injector are normally constructed of steel. For some purposes involving contact between the tubing and the tensioning wheel, high stiffness rubber or plastics are typically used.

Much of the equipment mounted on the trailer in FIG. 1 is commercially available and is included herein only for purposes of illustrating the need for and use of the selectably elevatable coiled tubing injector.

For the figures herein, certain components are not shown in order to avoid overly complicating the drawings. For example, control cables, hydraulic lines, and the fluid system for feeding the reel are not shown. All of these features are well known to those skilled in the art and so they are not described herein.

Figure 2:
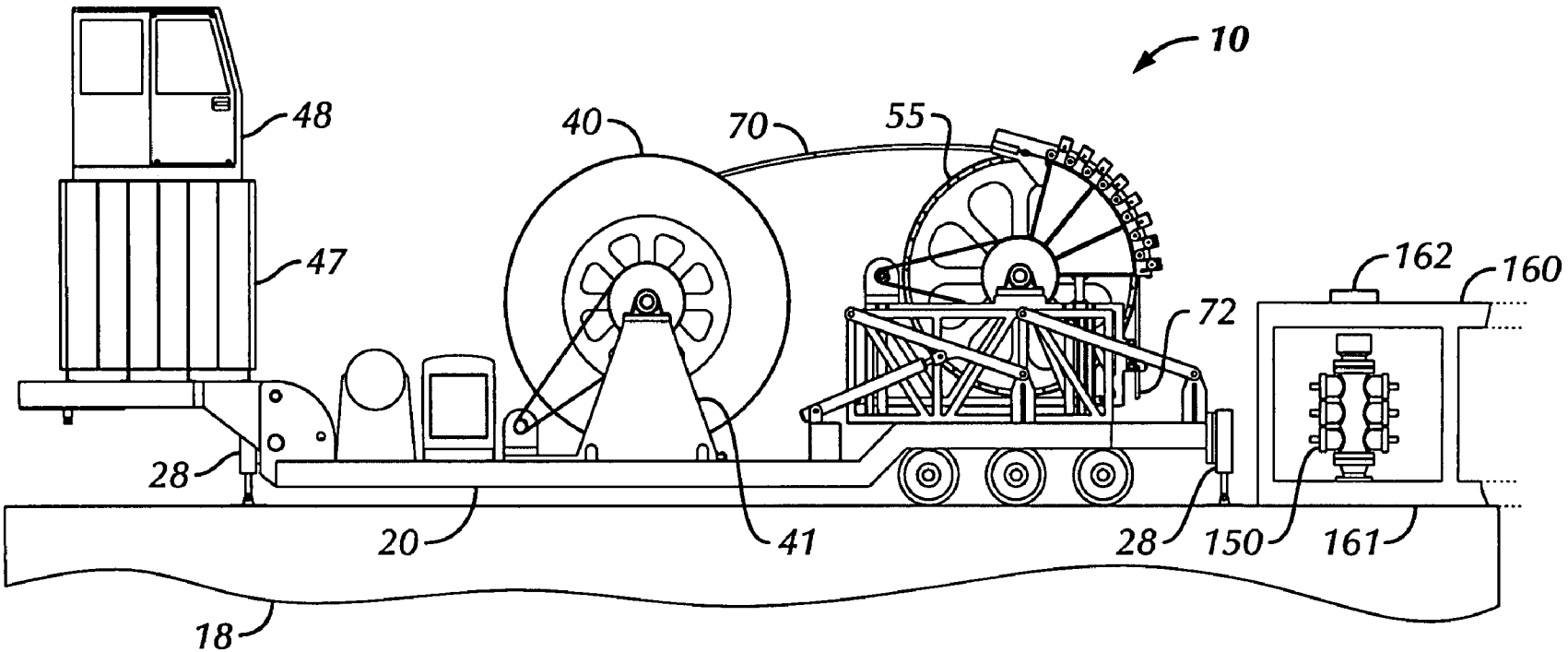
FIG. 2 is a side profile view of the coiled tubing rig arrangement of FIG. 1.
Figure 3:
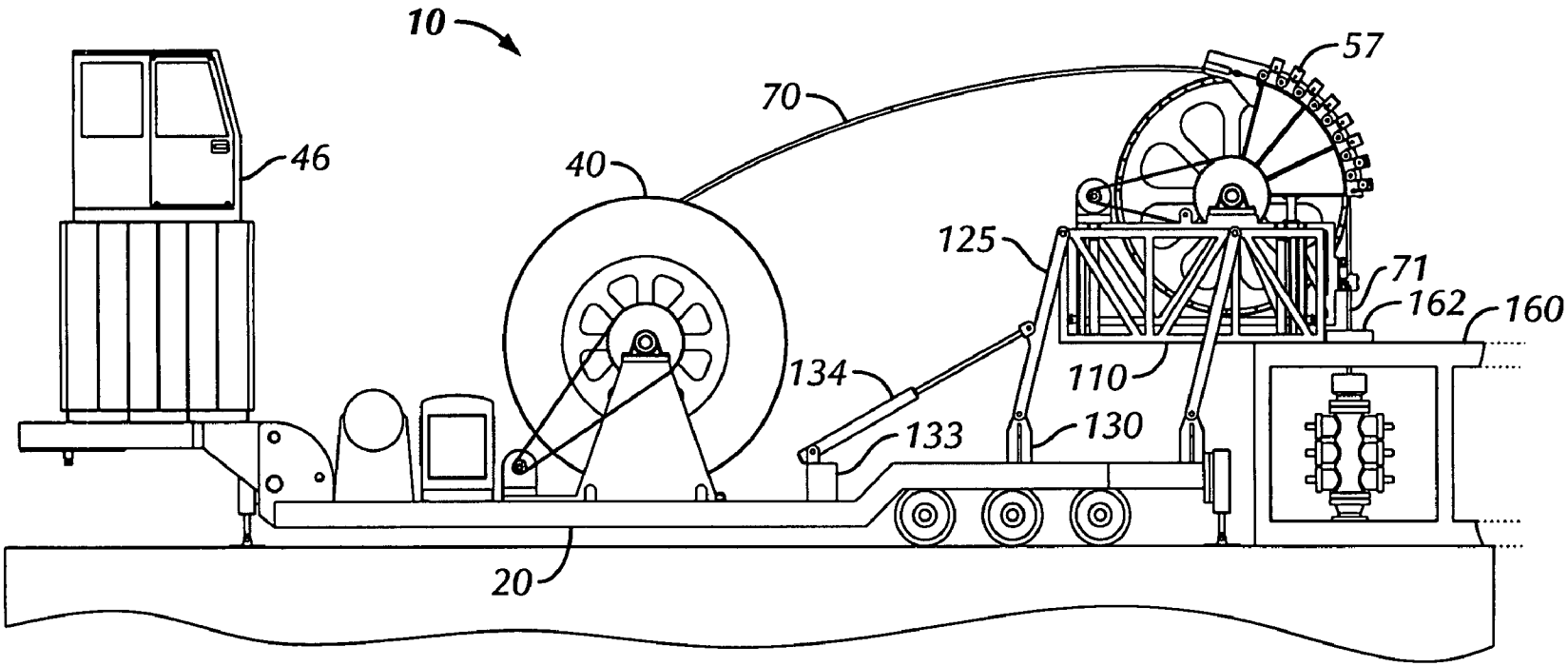
FIG. 3 is a side profile view of the coiled tubing rig with its tubing injector elevated to rest on the rig floor of a drilling rig. For clarity, the mast and other accoutrements of the drilling platform are not shown.
Figure 4:
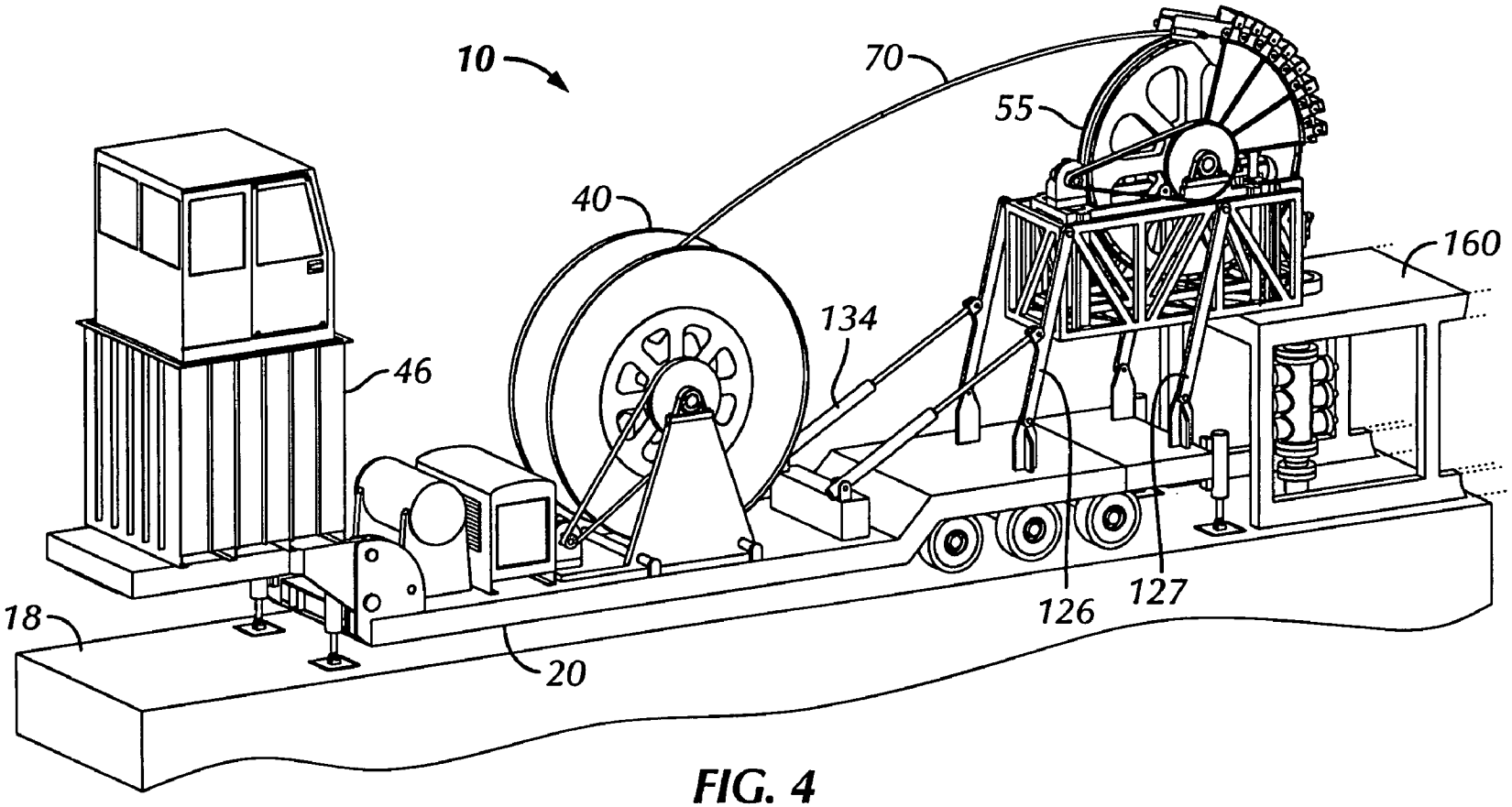
FIG. 4 is an oblique view of the coiled tubing rig with its tubing injector resting on the rig floor of the drilling rig.

Referring to FIGS. 1 and 2, an integrated trailer mounted coiled tubing rig 10 utilizing the coiled tubing injector 50 of the present invention is shown in an oblique and a side profile view, respectively. This mobile coiled tubing rig 10 is suitable for use in drilling or servicing wells. The rig 10 is shown positioned prior to having its injector 50 set up and working on a drilling rig floor 160 at a well location. The rig arrangement shown is fairly typical of commercially available coiled tubing rig layouts, with the exception of the supporting arrangements for the injector 50 and the combination of the control room 48 and the auxiliary water tank 47 into an integrated control room assembly 46.

The basic elements of a trailer mounted coiled tubing rig 10 are a tractor (not shown) for pulling the trailer 20, a rig power unit 31 fed by fuel tank 30, a tubing storage reel 40, a tubing injector system 50, tubing 70, and a control room 48. The power source 31, the fuel tank 30, the tubing storage reel 40, the tubing injector 50, the tubing 70, and the control room 48 are all mounted on the trailer 20. Trailer 20 is normally of the "low boy" type, given that the tubing storage reel 40 is normally rather tall. The length of the low boy trailer is at or close to a maximum practical length for transport over the unimproved roads that frequently are the only access to well locations. The entire rig 10 is supported on surface 18, which can be either a roadway or the surface of the ground.

The low boy trailer 20 has an elevated rear deck 21, a depressed central deck 23, and an elevated forward deck 22. All of the deck segments 21, 22, and 23 are parallel to the ground. The rear deck 21 has multiple axles with tires 26 and a suspension system (not shown) supporting it underneath. This sort of arrangement for the trailer 20 is in common use in the trucking industry. The decks 21, 22, and 23 have longitudinal beams underneath which are structurally connected to the decks to provide bending strength and stiffness to the trailer 20.

Selectably axially reciprocable stabilizing jacks 28 are located at the forward outboard corners of the central deck 23 and the rear outboard corners of the rear deck 21 of the trailer 20. These jacks 28 are extended to firmly engage the surface 18 when the trailer 20 is positioned ready to service a well. The jacks 28 are used so that the trailer 20 is stabilized as the amount of tubing 70 on the tubing storage reel 40 changes or and/or the injector is moved thereby shifting the load on the trailer. In addition, the loads on the trailer 20 and its jacks 28 will change whenever the tension changes on the tubing 71 adjacent the wellhead.

The fuel tank 30 is located adjacent the forward end of the central deck 23, and the power unit 31 is located slightly to the rear of the fuel tank. The fuel tank 30 is mounted on a pair of pedestals and is a standard cylindrical tank with elliptical ends. The fuel tank 30 provides a sufficient supply of fuel to operate the power unit 31 for a period long enough to complete most jobs without refueling. The power unit 31 drives one or more hydraulic pumps and an electrical generator to power the reeling and tensioning of the coiled tubing 70 and other functions of the trailer mounted rig 10.

The tubing storage reel 40 is a large device which stores a sufficient amount of steel tubing 70 to permit reaching the bottom of the wells for which the rig 10 is capable. The tubing storage reel 40 both pays out and retrieves the tubing 70, although most of the tension or compression in the tubing string is provided by the injector 50. The location of the tubing storage reel 40 is on the central deck 23 to the rear of the power unit 31 and forward of the rear deck 21 of the trailer 20. Levelwinding of the tubing 70 is required to achieve compact storage and avoid overstressing the tubing 70 where wraps of tubing cross each other. The hub of the reel 40 has a diameter sufficiently large that repetitive bending cycles of the tubing 70 will not prematurely fatigue the tubing. The tubing 70 coiled on the reel 40 is laterally constrained between opposed side flanges.

The reel 40 has a horizontal shaft which provides a rotational axis which is transverse to the longitudinal vertical midplane of the trailer 20. The shaft is supported by a large pillow block bearing on each side, while the pillow blocks are in turn supported on a pedestal 41. The pedestal 41 consists of a pair of trapezoidal vertical spaced apart slabs parallel to the sides of the trailer 20 and joined by a rectangular base plate. The width of the pedestal 41 is approximately half of the width of the trailer 20. The base plate of the pedestal 41 extends a short distance forward of the forward edge of the pedestal slabs. The two slabs of the pedestal 41 each have a transverse forward and rear through hole parallel to and slightly above the base plate. The forward holes are mutually coaxial, as are the rear holes.

A large driven chain sprocket is mounted on the reel shaft on the lefthand side of the reel 40 so that the reel can be rotated bidirectionally by its drive chain. The drive chain is bidirectionally driven in turn by a small chain sprocket mounted on the output shaft of the hydraulic motor of hydraulic motor assembly. A hydraulic motor is mounted on a mounting base for the hydraulic motor assembly rigidly attached to the upper surface of the forward extension of the pedestal 41 so that the chain sprockets are in alignment.

A double acting hydraulic levelwind actuation cylinder selectably controlled from the control room assembly 46 has its cylinder body mounted transversely in a horizontal position to the upper surface of the central deck 23 of the trailer. The rod end of the levelwind actuation cylinder is attached to the middle of the base plate of the pedestal 41 on its rear vertical side. The pedestal 41 of the tubing storage reel 40 is supported slightly above the central deck 23 of the trailer 20 on a pair of tubular horizontal transverse guide rails engaged in the transverse holes at the bottom of the slabs of the pedestal.

Each of the two transverse guide rails is mounted by a pair of end blocks, with the outside transverse face of each end block flush with its respective side of the trailer 20. The combination of the length of the transverse guide rails 45 and the width between flanges of the reel 40 is selected so that system operator can controlled lateral shifting of the position of the reel by the levelwind actuation cylinder, thereby causing the coiled tubing 70 to properly nest on the reel.

The control room assembly 46 is positioned on the forward deck 22 of the trailer 20. The control room assembly 46 consists of an auxiliary tank 47 and the control room module 48. For travel, the control room module 48 is nested within the tank 47, but the control room can be selectably elevated to its upper position so that a human operator positioned there can more readily observe the general operation of the coiled tubing rig 10 and, particularly, the level winding of tubing 70 onto the storage reel 40. Alternatively, a more conventional control room arrangement can also be used satisfactorily.

The tubing injector system 50 is mounted on the longitudinal centerline of the rear deck 21 of the trailer 20. Although a variety of tubing injectors are suitable for use, the particular tubing injector shown here is a reversible wheel type injector and is used to apply the primary tractive loads to the tubing 70 to urge the tubing into or out of the well. Often a well servicing job requires that the tubing 70 be forcefully injected through a blowout preventer device 150 which seals between the wellhead and the portion of the tubing 71 which is entered within the well bore. Likewise, frequently the weight of the tubing 71 in the well exceeds the axial pressure load applied to the tubing, requiring tractive force to lift the tubing from the well.

Figure 5:
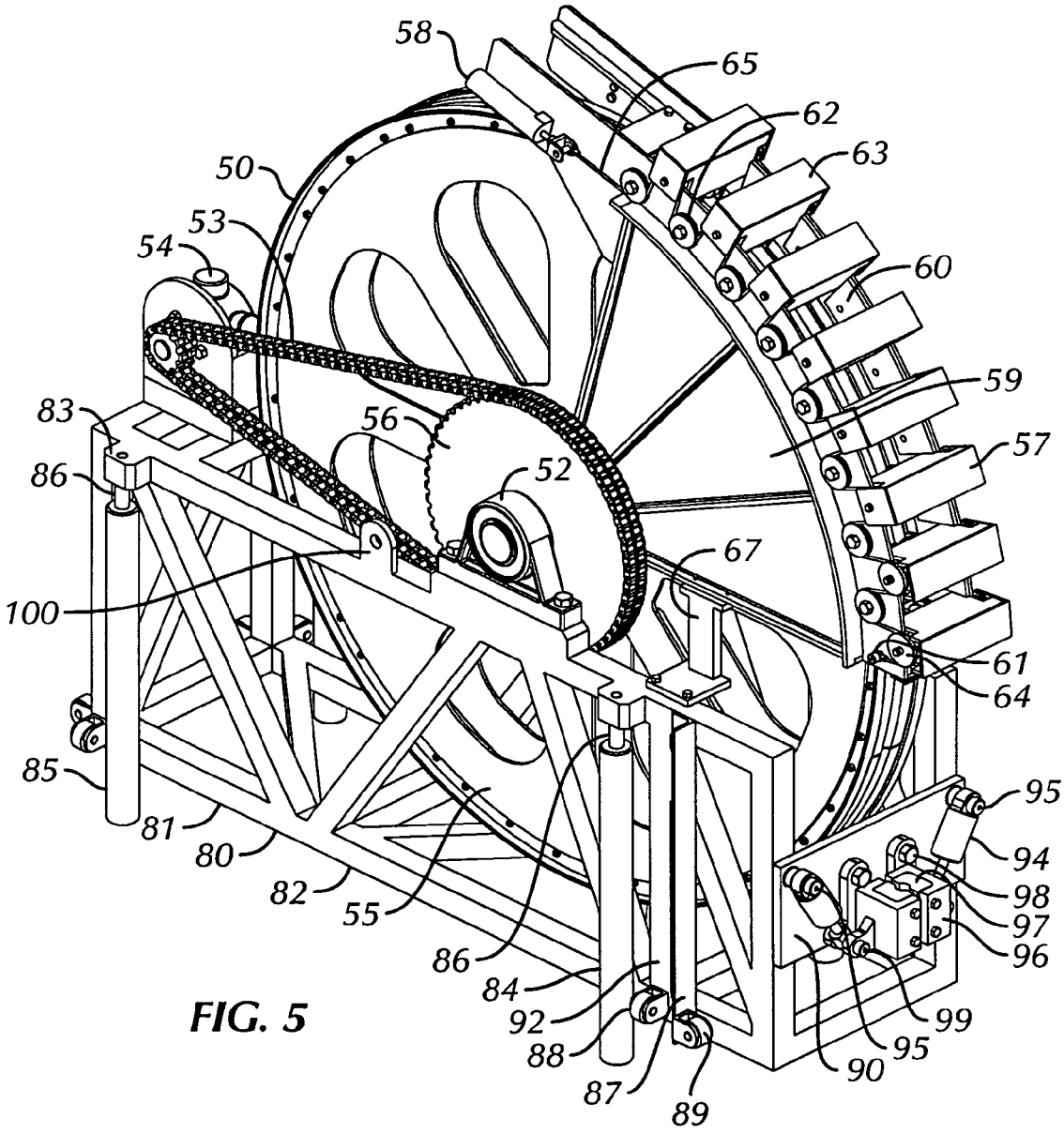
FIG. 5 is an oblique view of the coiled tubing injector mounted in an injector cradle.

Referring to FIG. 5, the tubing injector system 50 consists of a drive wheel 55 mounted on a pair of pillow block bearings 52 and driven by a hydraulic motor assembly 54 engaging a drive chain 53. A structure supporting a series of coacting radially inwardly urged rollers constitutes a radially inwardly acting holddown mechanism 57.

The drive wheel 55 has two parallel circular side plates connected by a cylindrical annular ring set inwardly a short distance from their outer circumference. An array of multiple closely spaced support blocks 66 are fitted to the annular ring on their inward side and have an annular groove in the center of their outer side. Through bolts with nuts parallel to the wheel axis penetrate the side plates and the support blocks to provide support to the tubing 70 in the groove of the support blocks.

The drive wheel 55 has an axial horizontal shaft coaxially attached to the side plates which provides a rotational axis transverse to the longitudinal vertical midplane of the trailer 20. The shaft is supported by a large bearing pillow block 52 on each side, while the pillow blocks are in turn supported on the upper surface of the injector cradle assembly 81 of the tubing injector support system 80.

A large drive chain sprocket 56 is mounted on the shaft on the lefthand side of the drive wheel 55 so that the wheel can be rotated bidirectionally by drive chain 53. Drive chain 53 is bidirectionally driven in turn by a small chain sprocket mounted on the output shaft of the hydraulic motor of hydraulic motor assembly 54. The hydraulic motor is mounted on a mounting base for the hydraulic motor assembly 54 which is in turn rigidly attached to the upper surface of the injector cradle 81 so that the chain sprockets are in alignment.

The tubing injector system 50 is provided with a radially inwardly acting holddown mechanism 57 which serves to force the tubing 70 engaged around the drive wheel inwardly against the tubing support blocks 66 of the drive wheel 55. This radially inward forcing ensures high frictional forces can be developed between the drive wheel 55 and the tubing 70, regardless what the tension in the tubing is. The radially acting holddown mechanism 57 is coaxially structurally supported on the shaft of the drive wheel by a holddown support frame 59 consisting of two nonrotating mirror image reinforced plate arcuate sectors which straddle drive wheel 55. The holddown support frame 59 is prevented from rotating by two mirror image antirotation braces 67 which connect between the support frame 59 and the upper surface of the injector cradle 81.

The radially inward holddown reaction on the tubing 70 in the groove of the tubing support blocks 66 of the drive wheel 55 is provided by a set of circumferentially spaced apart parallel centrally grooved tubing rollers having axes parallel to the drive wheel and engaging the coiled tubing 70 over its arc of contact with the drive wheel. The tubing rollers are mounted on radially movable holddown roller assemblies 63 which are retained and guided within radial slots on the outer peripheral inward faces of the arcuate plate sectors of the holddown support frame 59. The radial slots are formed by circumferentially spaced apart guide plates 60 attached to the periphery of the opposed inward facing arcuate plates of the holddown support frame 59.

Each holddown roller assembly 63 has a pair of static sheaves 62 located adjacent each of its opposed distal ends. Static sheaves 62 are located on both outer sides of the arcuate plate sectors of the holddown support frame 59 inwardly from the periphery, with each static sheave mounted on the radial center plane of each guide plate 60 so that a static sheave straddles each radial guide slot. Each of the holddown roller assembly end sheaves 64 has its shaft parallel to the shafts of the static sheaves 62. Additionally, on each side of the holddown support frame 59, the grooves of the end sheaves 64 are coplanar with the grooves of the static sheaves.

On each side of the holddown mechanism 57, a single pulldown cable is anchored by a cale anchor 61 adjacent the bottom end of the array of static sheaves 62 and tensioned on its opposed end by a hydraulic tensioning cylinder 58. The hydraulic tensioning cylinders 58 are mounted on the upper end of the radially acting holddown mechanism 57 approximately tangentially to the rim of the drive wheel 55. The tensioning cables 65 are engaged alternately in the direction towards their tensioning hydraulic cylinders by the static sheaves 62 and the holddown roller assembly end sheaves 64. The net reaction force on each tubing roller of the holddown roller assemblies 63 is thus radially inward. This radially inward force enhances the frictional forces between the drive wheel 55 and the tubing 70, thereby permitting the tubing to be engaged only over a relatively small arc of the drive wheel in order to develop any necessary frictional tractive force.

Figure 6:
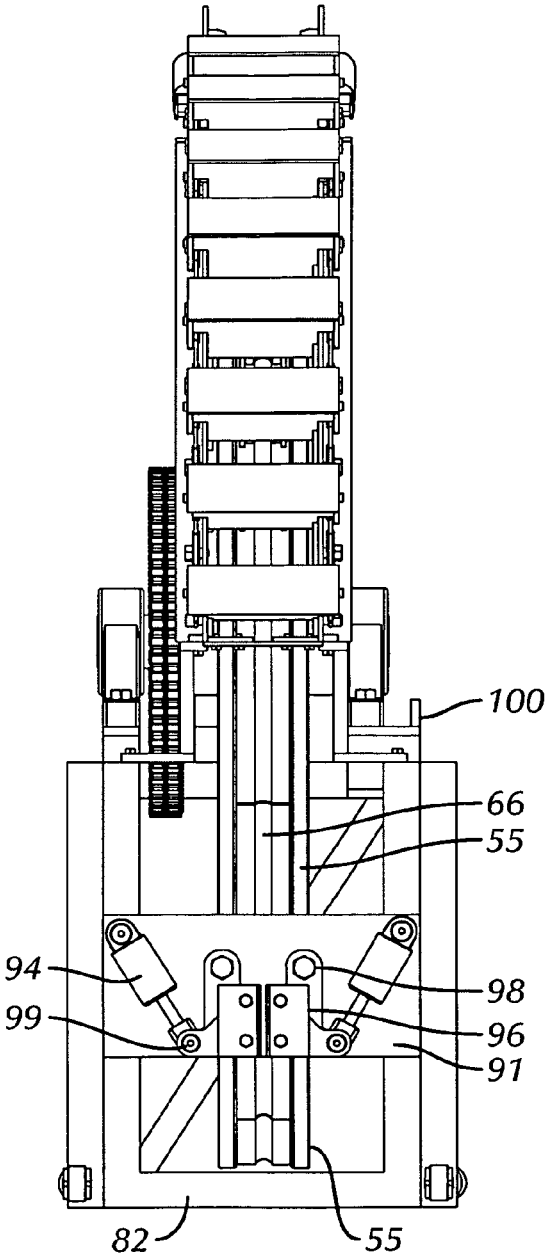
FIG. 6 is a view looking towards the front of the mounting trailer showing the coiled tubing injector in its injector cradle which is in turn positioned in an intermediate frame and the gripping blocks of tubing clamp assembly in a closed, gripping position.
Figure 7:
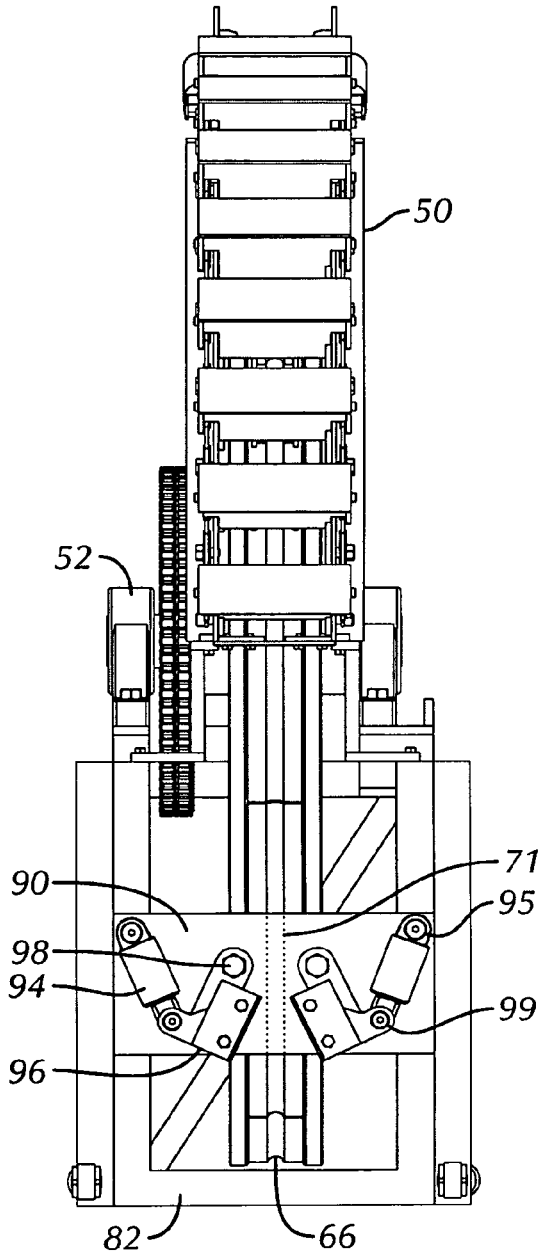
FIG. 7 corresponds to FIG. 6, but with the gripping blocks of the tubing clamp assembly in an open, nongripping position.

As best seen in FIGS. 5 through 7, the coiled tubing injector system 50 is mounted in an injector cradle assembly 81. The injector cradle 81 has a space frame 82 constructed primarily of square or rectangular tubing and provided with lift cylinders 84 and guide rollers 88, 89 and a clamp assembly 90. The space frame 82 has two mirror image trussed panel sides, a horizontal trussed panel bottom, and a trussed panel forward end. The lower portion of the rear side of the space frame 82 is spanned by a clamp assembly 90 which is supported on a mounting plate 91, while the upper portion of the rear side of the space frame is open.

The width of the space frame 82 is the same as the spacing between the pillow block bearings 52 of the coiled tubing injector 50. The length of the space frame 82 is sufficient to mount the coiled tubing injector 50 so that its motor assembly 54 is supported at the front end and the vertical tangent to the drive wheel 55 is slightly to the rear of the rear end of the space frame. The height of the space frame 82 is such that when the coiled tubing injector 50 is mounted on the space frame, a small clearance will exist between the bottom panel of the space frame and the outer rim of the drive wheel 55 of the coiled tubing injector 50.

The upper horizontal chord of each side panel is provided with two outwardly projecting horizontal rectangular prismatic ears 83, with one ear near the forward end of the frame 82 and the other near the rear end of the frame. Each ear 83 has a central vertical tapped hole which is engaged by the male threaded rod end of the lift cylinder rod 86 of a hydraulic lift cylinder 84, with the bodies 85 of the lift cylinders below the ears.

A horizontal transverse cross bar joins the upper horizontal chords of the space frame 82 a short distance to the rear of the front panel of the space frame 82. This cross bar, along with the top chord of the front panel, serves as a support for the hydraulic drive motor assembly 54 used to activate the drive wheel 55 of the coiled tubing injector 50. Each side panel has a pillow block mounting pad projecting upwardly on its upper horizontal chord slightly to the rear of midlength of the space frame 82. The pillow block bearings 52 for the coiled tubing injector 50 are mounted there. A vertically upwardly extending plate lifting eye 100 is located flush with the side panel outside face and at approximately midlength of the upper horizontal chord of each side panel.

A short distance to the rear of the rear cylinder mounting ear 83 on each of the side panels of the space frame, a vertical structural guidance angle 87 is rigidly mounted with one leg of the angle projecting forward and flush with the outside of its side panel and with the other leg of the angle extending transversely outwardly. An intermediate vertical side frame member 92 is located between the rearward cylinder attachment ear 83 and the guidance angle 87 in each space frame 82.

On each side of the space frame 82, a horizontal axis bracket mounted lateral restraint roller assembly 88 is mounted at the bottom end of each intermediate vertical side frame member positioned between the rearward cylinder attachment ear 83 and the guidance angle 87. The axes of the lateral restraint rollers 88 extend fore and aft and are positioned outboard of the side frames. On each side of the space frame 82, a horizontal axis bracket mounted longitudinal restraint roller assembly 89 is mounted at the bottom end of the transversely outwardly extending leg of the structural guidance angle 87 on that side so that the axis of the roller is to the rear of the angle.

On the forward end panel of the space frame 82, a horizontal axis longitudinal restraint roller assembly 89 is mounted at the intersection of the bottom chord of the front panel and each side panel so that the axes of the rollers are forward of the lower chord of the front panel. At the lower forward corner of each side panel of the space frame 82, a horizontal axis lateral restraint roller assembly 88 is mounted with its axis outboard of the outer side of the panel. The lateral restraint roller assemblies 88 are similar to or identical to the longitudinal restraint roller assemblies 89.

Referring to FIGS. 5, 6, and 7, the clamp assembly 90 consists of mounting plate 91, a pair of clamp hydraulic cylinders 94, a pivot pin 95 for each cylinder 94, a pair of mirror image clamp support blocks 96 with each containing a grip block 97, a pair of clamp support block pivot pins 98, and a pair of clamp cylinder rod end pins 99. The mounting plate 91 of the clamp assembly 90 is a transversely extending thick rectangular plate lapped onto and spanning between the side panels of the space frame 82 of the injector cradle 81 of the tubing injector support system 80. The mounting plate 91 is positioned slightly above the bottom side of the rear face of the space frame 82.

The upper corners of the mounting plate 91 each have a horizontal through drilled and tapped hole extending parallel to the side panels of the space frame 82. These drilled and tapped holes serve to mount the pivot pins 95 for the eye brackets located at the blind ends of the cylinder bodies of the double acting single rod clamp cylinders 94. Another pair of mirror image drilled and tapped horizontal through holes are spaced apart by approximately 30 percent of the width of the mounting plate 91 approximately one third of the height of the mounting plate down from its upper edge. This second pair of holes serves to mount the clamp support block pins 98. The pivot pins 95 for the cylinders 94 are typically headed bolts having large diameter shanks and distal end threads which are threadedly engaged with the outer upper corner tapped holes of the mounting plate 91. The clamp support block pins 98 are generally hex head bolts having large diameter shanks and distal end threads threadedly engaged with the central tapped holes of the mounting plate 91.

The clamp support blocks 96, which are best seen in FIG. 5 in an oblique view, are mirror image pieces which each have an elongated planar mounting plate onto which is integrally mounted a heavy U-shaped channel member. Each planar mounting plate has a through hole for journaling the shank of a clamp support pin 98 and has its channel radially spaced outwardly from its through hole. The trough of a channel extends parallel to and offset from the plane of its planar mounting plate. The flanges of each channel have a pair of through holes on their rear flange and a pair of tapped through holes on the forward channel leg. Each rear flange through hole is coaxial with a tapped forward hole.

The back of each channel is perpendicular to its mounting plate and approximately coplanar with the through hole in the planar mounting plate of each clamp support block 96. A vertical integral swing arm projects on the vertical plane of symmetry of the channel back on the section of the channel distal from the pivot pin hole. The swing arms are parallel to and offset from the planar mounting plates. Each swing arm extends in a direction opposed to the legs of its channel and has a through hole parallel to the through hole in the mounting plate of the clamp support block 96. The through hole in each swing arm is engaged with and journals a screw with a cylindrical shank and distal male threads which serves as a rod end pin 99 for the clamp cylinder 94. The rod end of the clamp cylinder 94 is provided with a female rod eye knuckle having a tapped hole transverse to and intersecting the longitudinal axis of the cylinder. The rod end pin 99 of each cylinder 94 is threadedly engaged with the tapped hole of the female rod eye knuckle.

The grip blocks 97 of the clamp assembly 90 are rectangular cross section blocks which are mounted in the channels of the clamp support blocks 96. The grip blocks 97 have circular cross section grooves which are a close fit to the tubing 70. The depth of a groove is approximately 40 percent of the diameter of the tubing, and the groove runs in the middle of one side of the grip block. The grip block cross section is a close fit to the inside faces of the channel of a clamp support block, and the length of the grip block is the same as the length of its mounting channel. The grip blocks 97 extend slightly outwardly from the channels. Transverse through holes parallel to the grooved face of the grip blocks 97 are coaxial with the holes in the flanges of the channels of the clamp support blocks 96 so that bolts can be extended through those holes and the corresponding holes in the grip blocks in order to retain the grip blocks.

The clamp support blocks 96 with their integrally mounted grip blocks 97 are pivotable about their clamp support block pins 98 when the cylinders 94 are actuated. The cylinders 94 are operated in parallel by a single valve (not shown). The extension of the cylinders 94 causes the clamp support blocks 96 to jointly pivot about their clamp support pins 98 as seen in FIG. 6. Similarly, the retraction of the cylinders 94 causes the clamp support blocks 96 to move apart as shown in FIG. 7. The relative positioning of the grooves of the grip blocks 97 and the vertically extending coiled tubing section 71 deploying into a well is such that the midplanes of the grooves are coplanar with the axis of the vertical tubing section.

Figure 8:
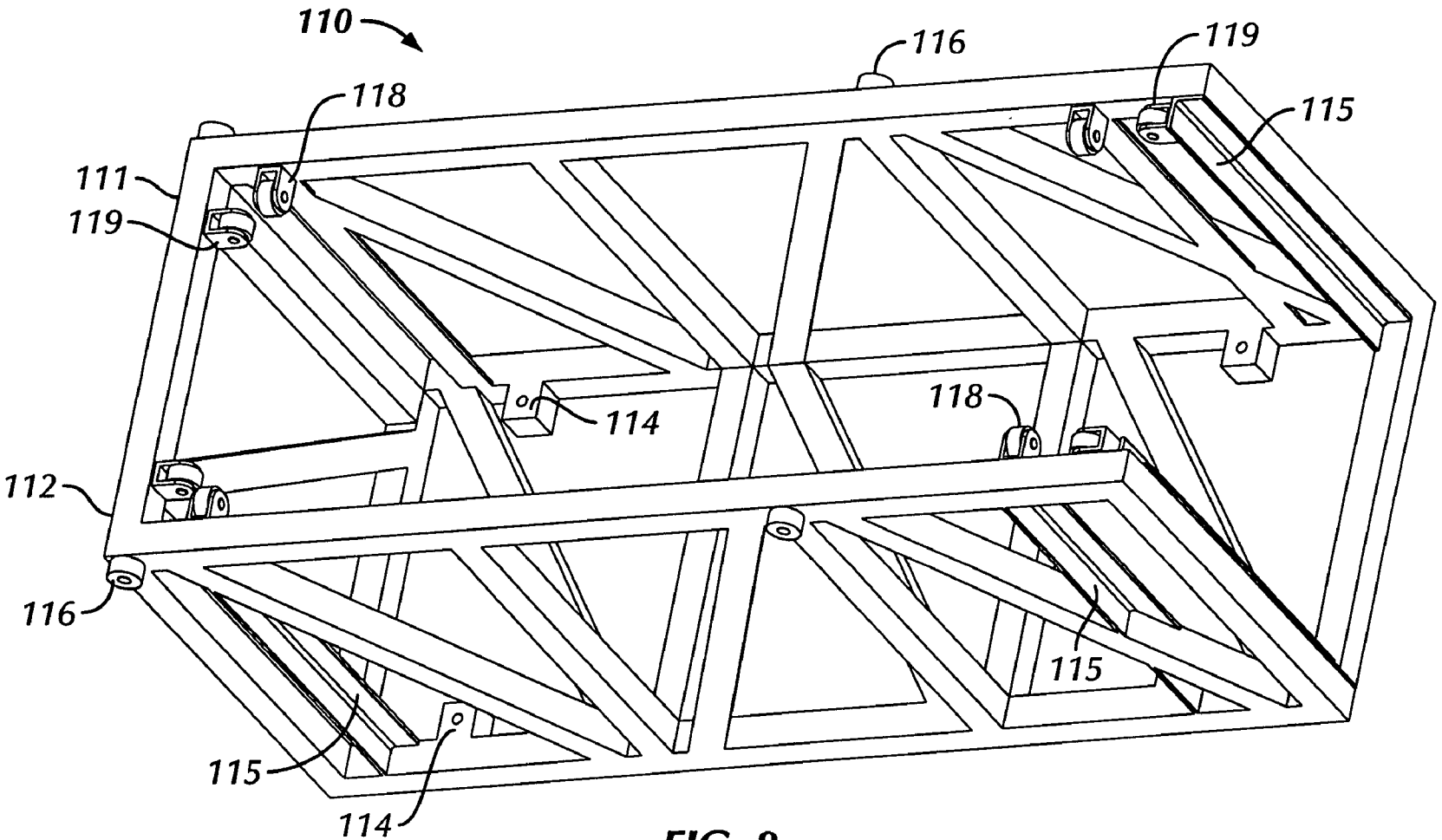
FIG. 8 is an oblique view of the intermediate frame which supports the tubing injector and its mounting cradle.

FIG. 8 shows an oblique view of the intermediate frame assembly 110 of the tubing injector support system 80. The intermediate frame assembly 110 supports the injector cradle assembly 81 which in turn supports the coiled tubing injector 50. The intermediate frame 110 consists of a space frame 111 constructed primarily of square or rectangular tubing and provided with guide rollers 118 and 119. The space frame 111 has two mirror image trussed panel sides, a horizontal trussed bottom panel, and a transverse trussed forward end panel at the forward end 112 of the space frame. The trussed forward end panel has two vertical tubular members set inwardly from the side panels by a short distance and a single diagonal between those verticals. The rear side of the space frame 111 is open except for a transverse horizontal member of the bottom panel.

The width of the space frame 111 is sufficiently large that the interior faces of its side frames will have a fit with the lateral restraint rollers 88 of the injector cradle 81 such that the rollers can readily guide the vertical movement of the injector cradle relative to the intermediate frame 110. The length of the space frame 111 is slightly less than that of the injector cradle assembly 81. The height of the space frame 111 is such that when the injector cradle 81 is mounted within the space frame and reciprocated vertically to its highest position by the lift cylinders 84, enough of the cradle 81 is retained within the intermediate frame to ensure stability under operating loads.

The lower horizontal chord of each side panel of the intermediate space frame 111 is provided with two inwardly projecting horizontal rectangular prismatic ears which serve as lift cylinder mounting pads 114, with one ear near the forward end of the frame and the other near the rear end of the frame. The spacing between the lift cylinder mount pads 114 on each side frame panel is the same as that for the lift cylinder rod attachment ears 83 of the injector cradle 81. Each lift cylinder mounting pad 114 has a central vertical through hole which journals a machine screw (not shown) which can be threadedly engaged with a tapped mounting hole on the blind end of a lift cylinder 84 to rigidly attach the cylinder body of a lift cylinder to the upper surface of the lift cylinder mounting pad.

A short distance to the rear of the rear cylinder mounting pad 114 on each of the side panels of the space frame, two coaxial segments of a first pair of vertical structural guidance angles 115 are rigidly mounted with one leg of the angles projecting to the rear flush with the inside face of its side panel and with the other leg of the angles extending transversely outwardly. These first angle 115 segments are cut so that each one has one end attached to a horizontal chord and the other end attached to an adjacent diagonal of its side panel.

A short distance to the rear of the front transverse panel of the space frame 111 on each of the side panels of the space frame, two coaxial segments of a second pair of vertical structural guidance angles 115 are rigidly mounted with one leg of the angles projecting to the rear flush with the inside face of its side panel and with the other leg of the angles extending transversely outwardly. These second angle 115 segments also are cut so that each one has one end attached to a horizontal chord and the other end attached to an adjacent diagonal of its side panel.

A short distance to the rear of the first set of guidance angles 115 is a third pair of guidance angles. For the third pair, on each of the side panels of the space frame 111, a vertical structural guidance angle 115 is rigidly mounted with one leg of the angle projecting to the rear and flush with the inside of its side panel and with the other leg of the angle extending transversely inwardly. The forward transverse faces of the third pair of guidance angles 115 are flush with the rear transverse horizontal cross member of the bottom frame panel.

Figure 12:
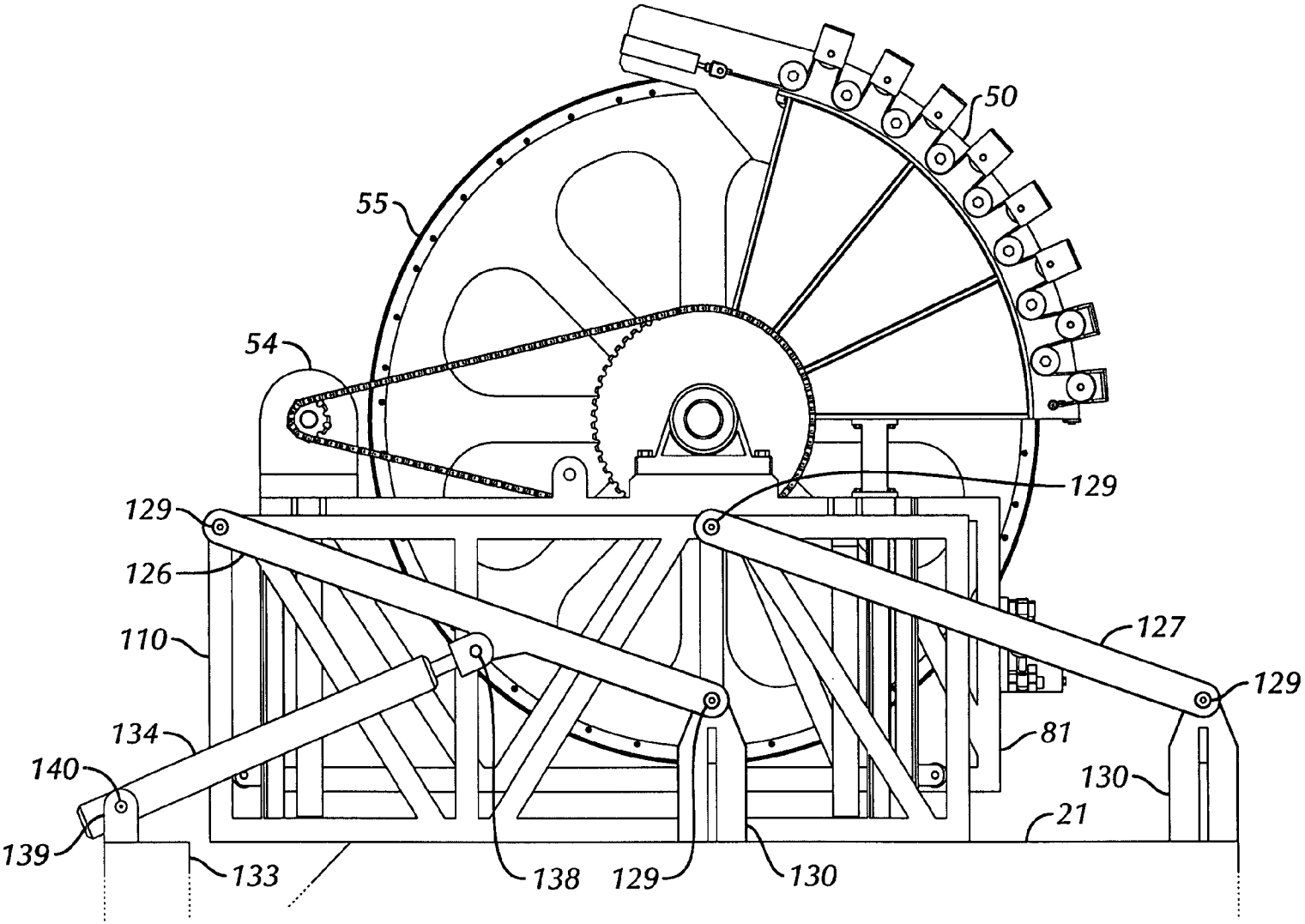
FIG. 12 is a partial view of the rear end of the trailer showing the coiled tubing injector in its cradle and in the intermediate frame, wherein the unit is resting on the rear deck of the trailer.

Each side panel of the space frame 111 has a pair of horizontally outwardly projecting cylindrical pivot arm mounting bosses 116 on its upper horizontal chord. The first boss 116 of the pair on a side panel is located at the forward end 112 of the space frame 111, while the second boss is located approximately 65 percent of the length of the space frame to the rear. Each boss 116 has a tapped centrally located transverse horizontal hole for threaded engagement with an arm end pin 129 so that either a first 126 or second 127 swing arm can be pivotably mounted there as shown in FIG. 12.

On each side of the space frame 111 of the intermediate frame assembly 110, a horizontal axis bracket mounted lateral restraint roller assembly 118 is mounted at the upper end of each first pair of vertical guidance angles 115. The axes of the lateral restraint rollers 118 extend fore and aft and are positioned inboard of the side frames. The spacing between these opposed lateral restraint rollers 118 is such that they can bear on and freely roll on the outwardly facing planar vertical face of the intermediate vertical side members 92 of the injector cradle 81.

On each side of the space frame 111, a horizontal axis bracket mounted longitudinal restraint roller assembly 119 is mounted at the upper end of the transversely inwardly extending leg of the third structural guidance angle 115 on that side so that the axis of the roller is to the front of the angle. The lateral restraint roller assemblies 118 are similar to or identical to the longitudinal restraint roller assemblies 119. The spacing between these longitudinal restraint roller assemblies 119 is such that the rollers bear on the rear face of the vertical guidance angles 87 of the injector cradle 81.

On the forward end panel of the space frame 111, a horizontal axis longitudinal restraint roller assembly 119 is mounted on the rear face of the top chord of the front panel so that the axes of the rollers are to the rear of the upper chord of the front panel. The spacing of the roller assemblies 119 is such that the rollers can bear on and freely roll on the front face of the forward vertical members of the side frames of the injector cradle 81 when that cradle is positioning within the intermediate frame assembly.

A few inches to the rear of the front frame panel of the space frame 111, two opposed horizontal axis lateral restraint roller assemblies 118 are mounted with their axes inboard of the inner sides of their respective side frame panels. When the injector cradle 81 is positioned in the intermediate frame assembly 110, the spacing between these opposed lateral restraint rollers 118 is such that they can bear on and freely roll on the outwardly facing planar vertical face of the second (forward) pair of vertical guidance angle segments 115.

The positioning of the forward longitudinal restraint rollers 89 of the injector cradle 81 is such that they bear on and roll on the rear face of the inwardly set vertical members in the front frame panel of the space frame 111 of the intermediate frame assembly 110. The positioning of the third (rear) pair of vertical guidance angles 115 of the intermediate frame 110 is such that the rear longitudinal restraint rollers 119 of the injector cradle 81 bear on the forward vertical faces of those angles.

The location of the second (forward) pair vertical guidance angle segments 115 is such that the forward lateral restraint roller assemblies 88 of the injector cradle bear on and roll on the inner face of those angle segments 115. The location of the first (rear) pair of vertical guidance angle segments 115 is such that the rear lateral restraint roller assemblies 88 of the injector cradle 81 bear on and roll on the inner face of those angle segments 115.

Figure 9:
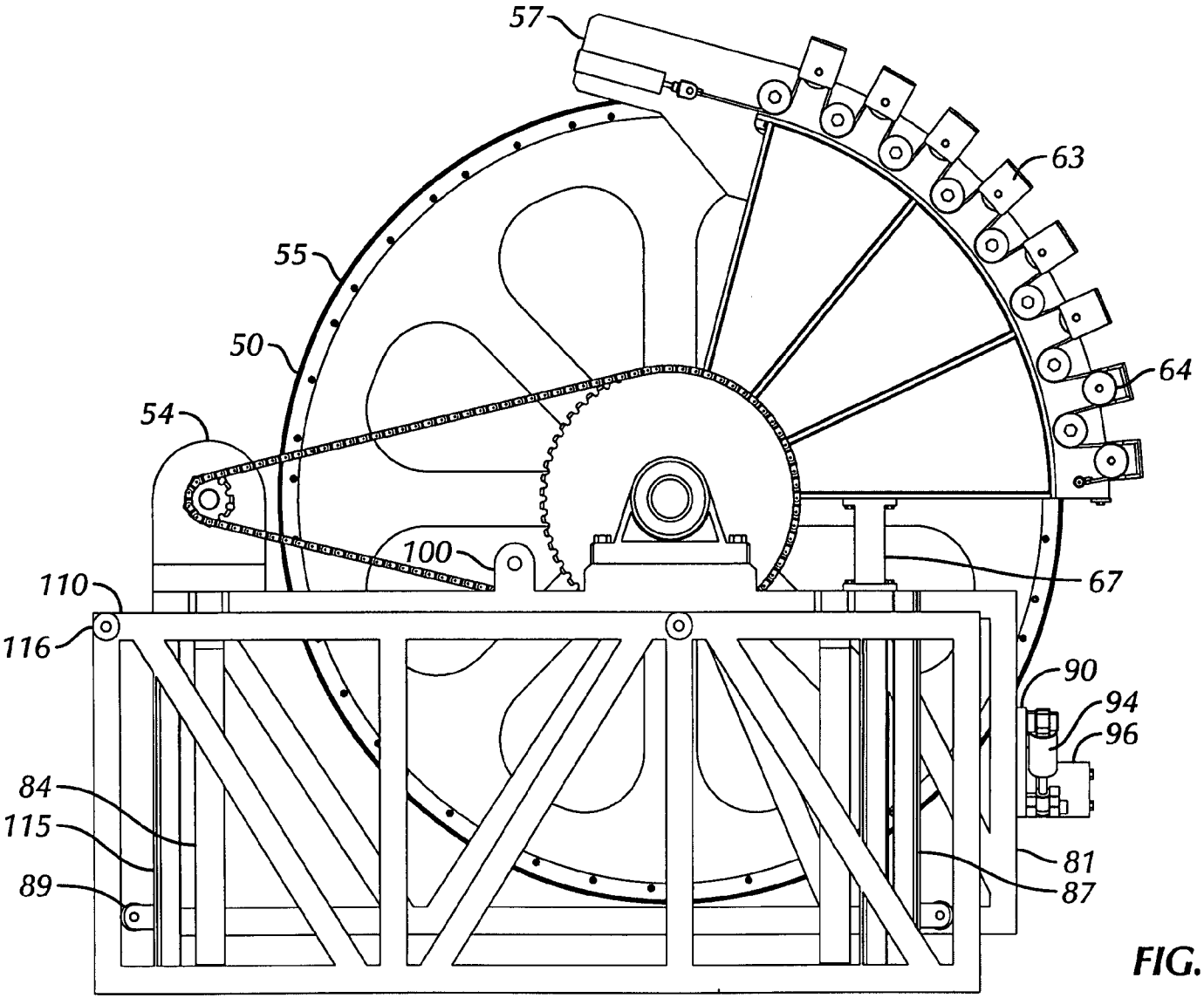
FIG. 9 is a side view of the tubing injector and its mounting cradle positioned within the intermediate frame.

Accordingly, the location in the horizontal plane of the injector cradle 81 relative to the intermediate frame 110 is closely controlled by the restraint roller assemblies 88, 89, 118, and 119 when the lift cylinders 84 vertically reciprocate the injector cradle 81 within the intermediate frame 110. FIG. 9 illustrates a side view of the intermediate frame assembly 110 housing the injector cradle 81 in its lower position.

Figure 13:
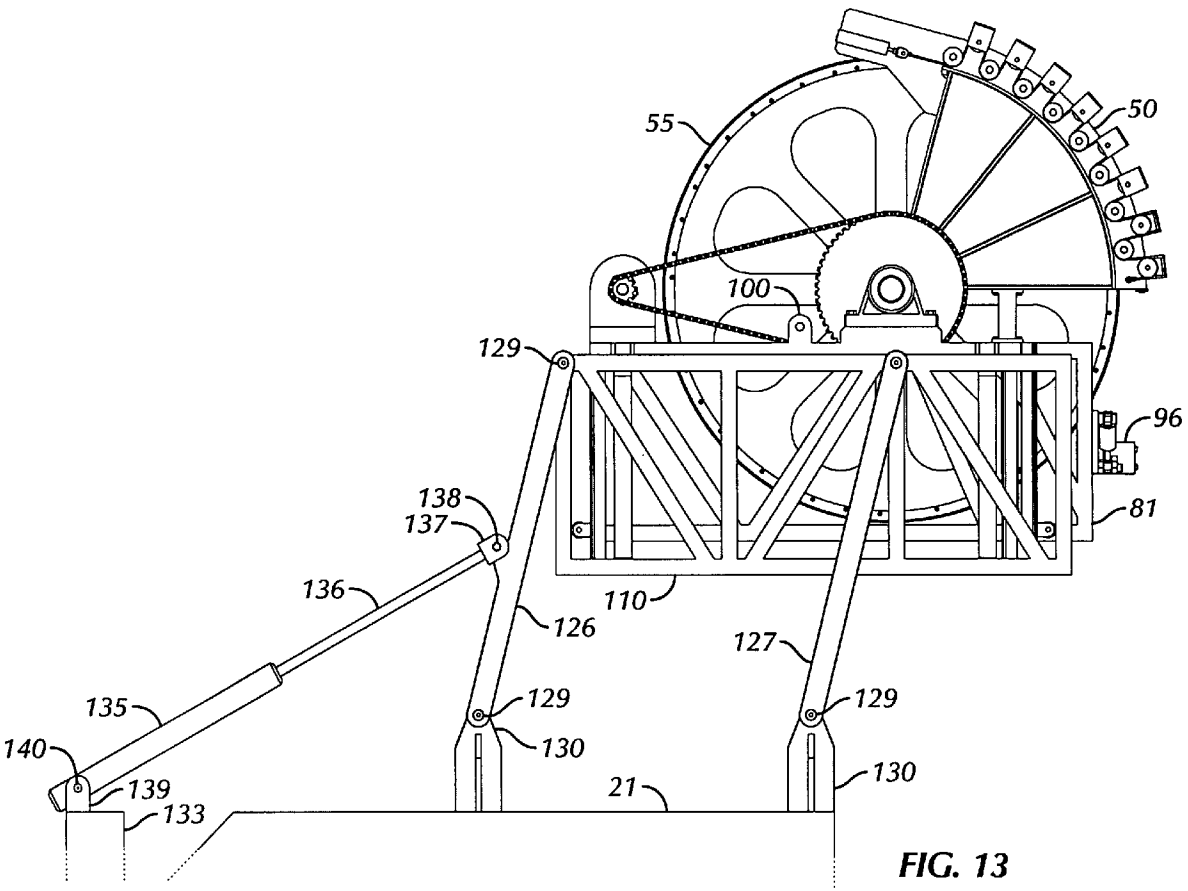
FIG. 13 corresponds to FIG. 12, but shows the tubing injector elevated for setting on a drilling rig floor by the swing arm assembly.

The swing arm assembly 125, best seen in FIG. 12 in its lower position and FIG. 13 in its upper position, consists of a pair of first arms 126, a pair of second arms 127, arm end pins 129, four arm pedestals 130, a pair of cylinder bases 133, and a pair of swing cylinders 134. The first 126 and second 127 swing arms are similar rectangular constant cross section tubular members having parallel horizontal axis through pivot holes at their ends. Both the first 126 and second 127 swing arms have the same length and distance between their pivot holes, but the first swing arms 126 also have a boss with a through hole parallel to their distal pivot holes on their lower sides positioned approximately 40 percent of the arm length from the pivot holes on their lower ends.

The arm end pins 129 are large bolts with cylindrical shanks which are close fits to the distal pivot holes of swing arms 126, 127. The upper four of the arm end pins 129 are journaled in the upper end pivot holes of the swing arms 126, 127 and have distal male threads which are threadedly engaged with the tapped holes in the cylindrical pivot arm mounting bosses on the outer sides of the intermediate frame 110.

Two identical arm pedestals 130 are located on each side of the rear deck 21 of the trailer 20. An arm pedestal 130 consists of a vertical main plate with a shorter central transverse vertical stiffening plate welded to the outboard side of the main plate. The main plate and the stiffening plate have coplanar horizontal bases, and the upper end of the main plate has a central transverse through hole which has tapped threads comatable with the distal threads of an arm end pin 129.

The forward arm pedestals 130 are mounted to the rear deck 21 with their tapped holes coaxial and their main plates equally offset from the centerline of the rear deck so that their main plates are parallel to the trailer centerline with their stiffening plates on their outboard sides. The rear arm pedestals 130 are positioned to the rear of the forward arm pedestals and mounted similarly. The spacing between the tapped holes at the upper ends of the forward and rear arm pedestals and the distance between the outer faces of the main plates of the opposed arm pedestals 130 is the same as the distance between the pivot arm mounting bosses 116 of the intermediate frame assembly 110.

The pivot holes, at the lower end of each of the first swing arms 126 and the second swing arms 127, journal arm end pins 129 which are threadedly engaged in the tapped holes of the arm pedestals 130. Thus, both first swing arms 126 and both second swing arms 127 are all mutually parallel. Because the first and second swing arms 126, 127 have the same length and are always parallel, the intermediate frame assembly 110 is always parallel to the rear deck 21 of the trailer 20.

The cylinder base 133 is a long rectangular prismatic box with integral opposed devises for mounting of the swing cylinders 134. The cylinder base is symmetrically transversely mounted on the central deck 23 of the trailer 20 and is itself symmetrical about the longitudinal midplane of the trailer. The cylinder base 133 extends across most of the width of the central deck. Each clevis on the upper side of the cylinder base consists of two parallel spaced apart vertical plates having coaxial through holes which are perpendicular to the longitudinal midplane of the trailer 20. The gap between an adjacent pair of plates in the devises is a loose slip fit to the mount 139 of the swing cylinder body 135 of the swing cylinder 134. The spacing between the devises of the cylinder base 133 is such that the lateral spacing of the axes of the swing cylinders 134 is the same as the spacing between the opposed first swing arms 126.

The two swing cylinders 134 are substantially identical double acting hydraulic cylinders, each with a rod clevis 137 having a clevis pin 138 on the distal end of its cylinder rod 136. The mounting of the body 135 of a swing cylinder 134 is provided by a swing cylinder mount 139 having mirror image horizontally transversely extending external upsets located close to the blind end of the cylinder body 135. The outer ends of the upsets are vertical and have central tapped horizontal holes with axes intersecting the longitudinal axis of their cylinder 134. The width of the swing cylinder mount 139 is such that it is a close slip fit between a pair of adjacent clevis plates on the cylinder base 133.

A pair of opposed bolts serve as an opposed pair of swing cylinder body pivot pins 140. For each swing cylinder 134, the swing cylinder body pivot pins 140 have their shanks journaled in the pivot holes of an adjacent pair of clevis plates of the cylinder base 133 and threadedly engaged with the female threads of the swing cylinder mount 139. Thus, the swing cylinder bodies 135 are pivotably mounted near their blind ends about the clevises of the cylinder base 133. Each swing cylinder 134 has its rod clevis connected by a rod clevis pin 138 to the transverse hole in the intermediate boss on the lower side of its first swing arm 126.

The swing cylinders 134 are actuated to extend or retract by pressured hydraulic fluid from the hydraulic system (not shown) of the coiled tubing rig 10 and controlled from the control room 48 by means of a four-way three position hydraulic valve. Reciprocation of the swing cylinders 134 causes the swing arm assembly 125 to move the intermediate frame assembly 110 with its attached injector cradle 81 in an arc between a traveling position on the rear deck 21 of the trailer 20, shown in FIG. 12, and an elevated position, shown in FIG. 13.

Referring to FIGS. 3, 4, 10, and 11, the coiled tubing rig 10 with the tubing injector support system 80 of the present invention is seen set up on a well location at which a drilling rig is present. For clarity in description, the drilling mast 164, drawworks 165, and crown block assembly 166 are not shown for these figures. These rig items and other equipment associated with the drilling rig are familiar to those skilled in the art, so the description herein is limited. The well is provided with a blowout preventer assembly 150 mounted on its wellhead. The substructure 161 of the rig straddles the wellhead and preventer 150 and supports a rig floor 160 above the preventer. A rotary table 162 is positioned on the rig floor 160 coaxially with the well bore. The coiled tubing rig 10 has its tubing deployed into the well, with the tubing section between the injector 50 and the well designated by numeral 71.

Figure 14:
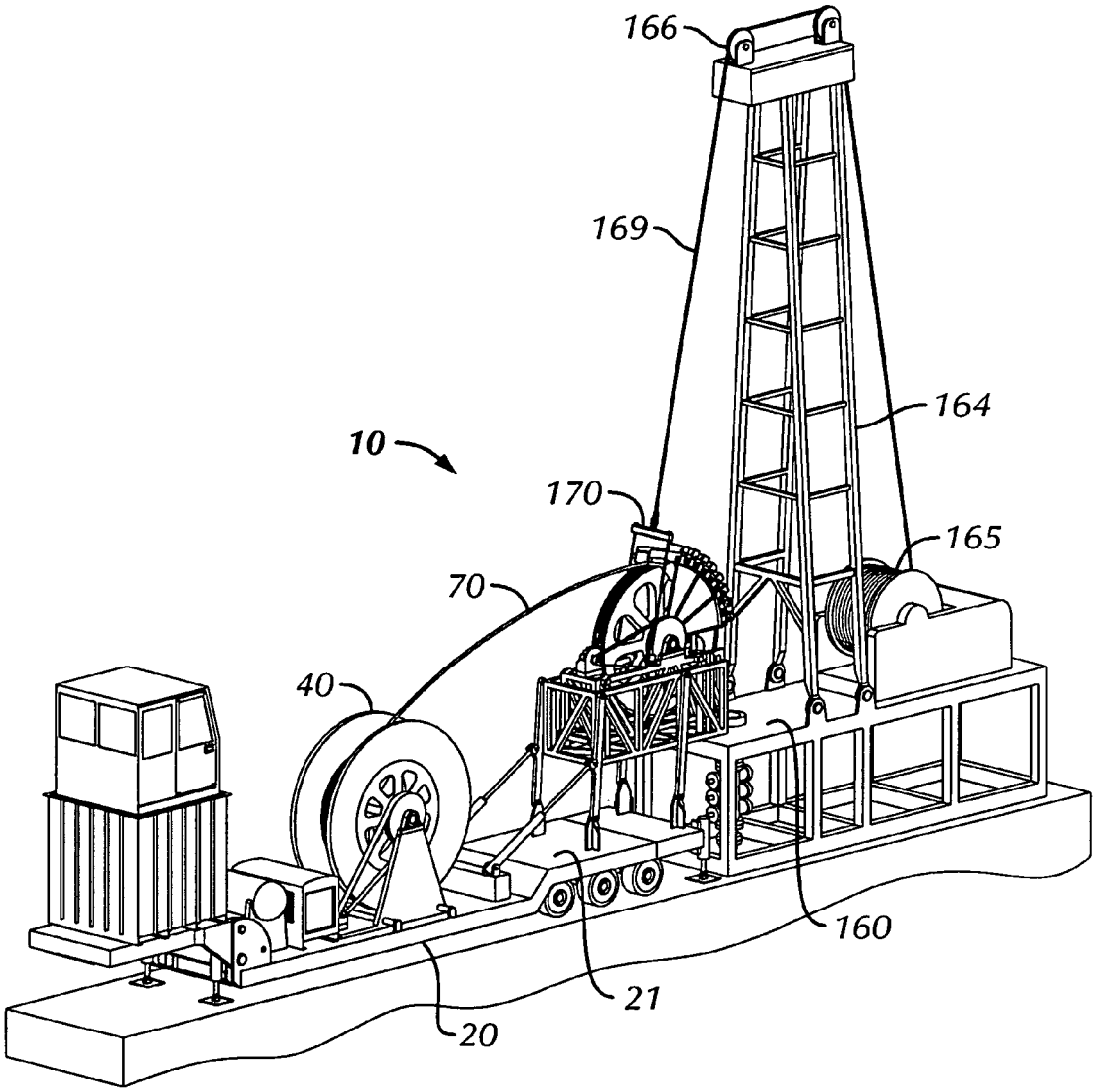
FIG. 14 is an oblique view showing the coiled tubing rig, where the coiled tubing injector is being positioned by manipulation of both a lifting line from the drilling rig and back tension from the coiled tubing storage reel.
Figure 15:
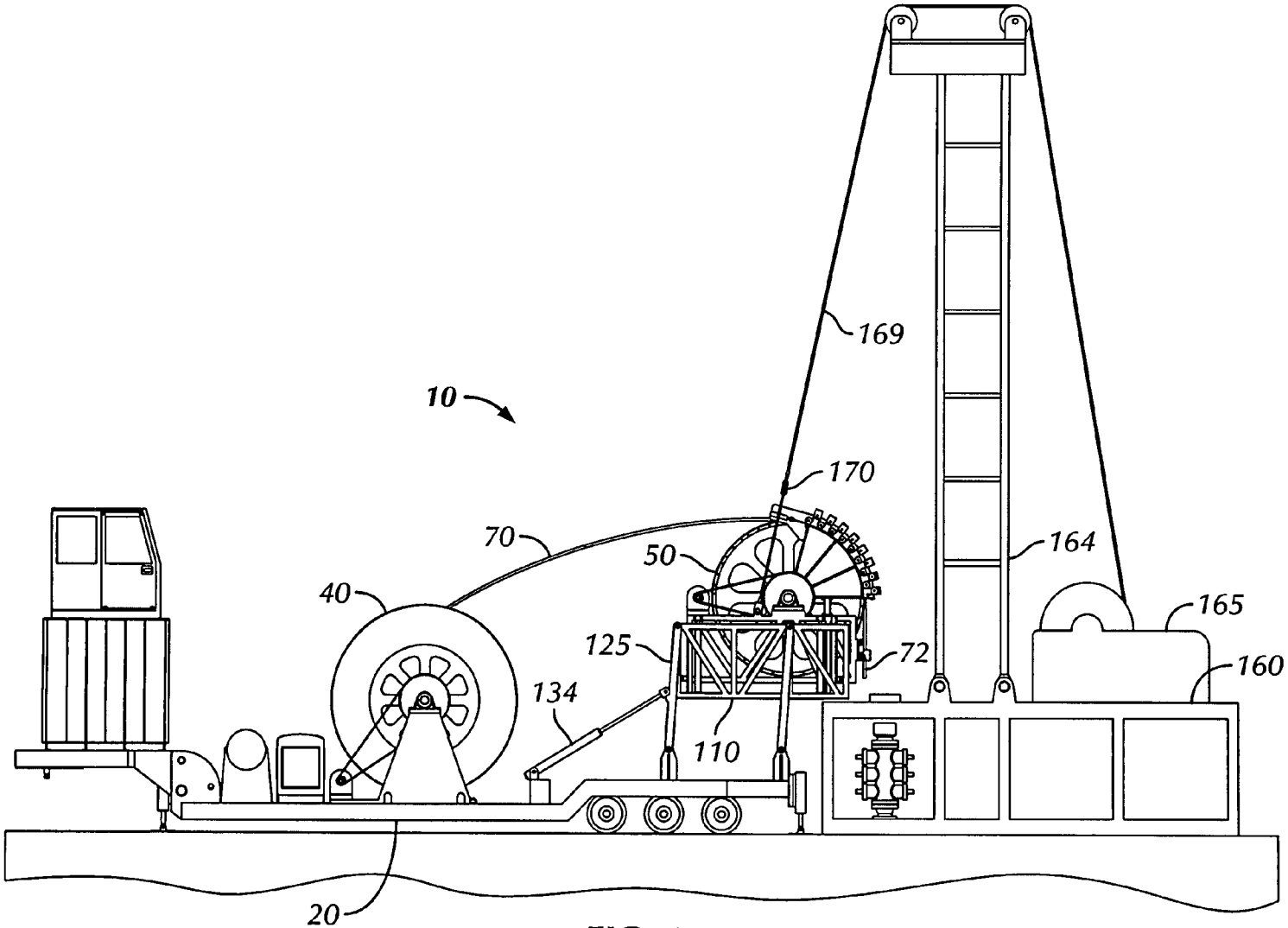
FIG. 15 corresponds to FIG. 14, but is a side profile view.
Figure 16:
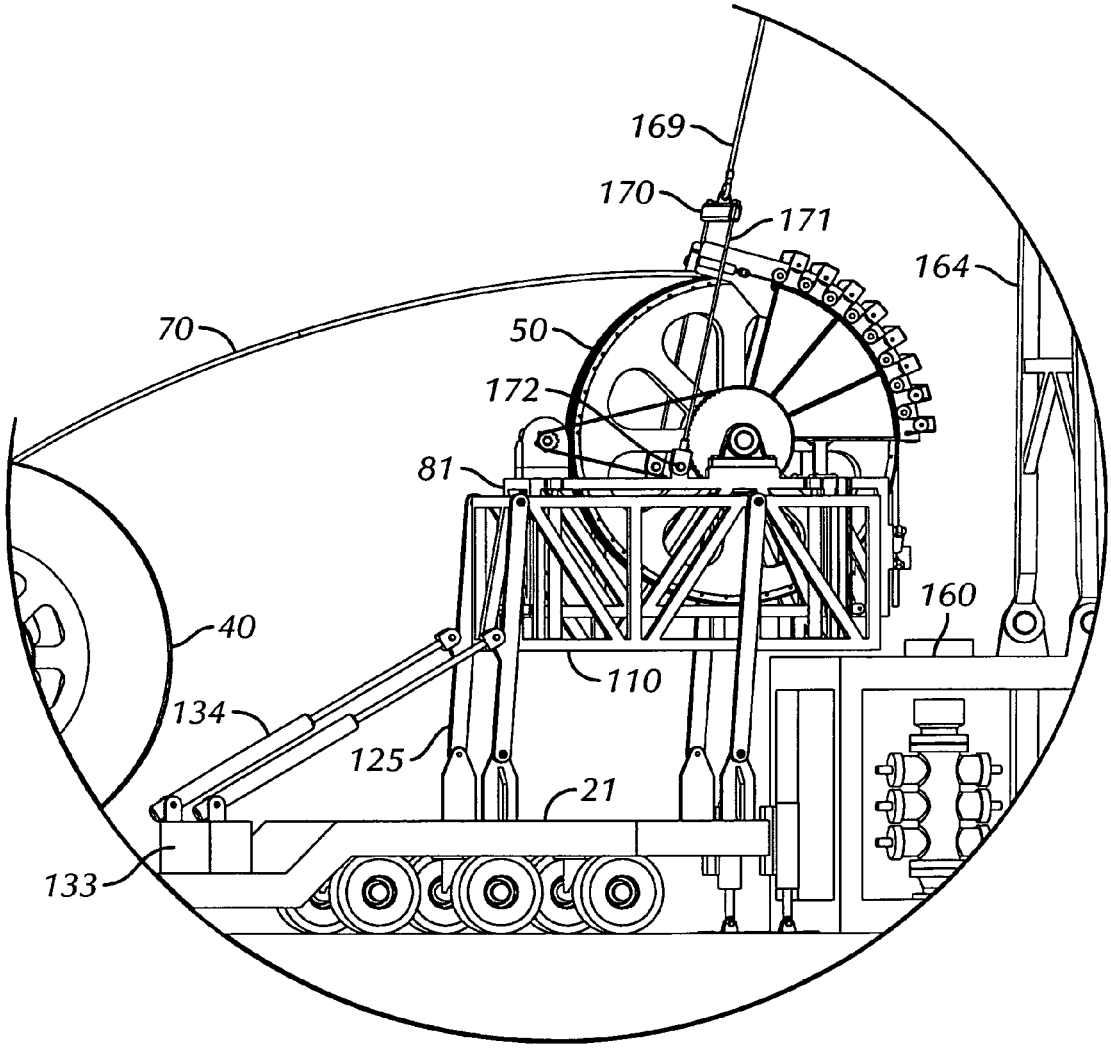
FIG. 16 is an oblique detail view corresponding to FIGS. 14 and 15, wherein the positioning mechanism for positioning the injector is shown in more detail.

FIGS. 14, 15, and 16 describe a coiled tubing rig 10 having an alternative lifting means for the movement of the swing arms 126 and 127 with the attached tubing injector support system 80. Here the movement of the swing arms 126 and 127 is effected by using a lifting line 169 which is controlled by the rig drawworks 165 and is dependent from the crown block assembly 166 mast 164 of the drilling rig.

Whenever the lifting line 169 is used as the lifting means for the swing arm assembly 125, a central pad eye on the upper side of a horizontal spreader bar 170 is attached to the free end of the lifting line 169. Lifting line 169 is dependent from the crown block assembly 166 at the upper end of the rig mast 164 and is wound around the drum of the drawworks 165 of the drilling rig. Mirror image spreader rods 171 or cables are attached at their upper ends to the distal ends of the spreader bar 170. At their lower ends, the opposed spreader rods 171 have clevises which are attached by spreader clevis pins 172 to the lifting eyes 100 on the upper chords of the side frames of the cradle space frame 82 of the injector cradle assembly 81. Whenever it is desired to move the tubing injector support system 80 in either direction between its first stowed position on the rear deck 21 of the trailer or its second position on the rig floor 160, the tubing is clamped by the clamp assembly 90.

Rather than using the hydraulic system of the coiled tubing rig 10 to actuate the swing cylinders 134 and thereby raise or lower the tubing injector support system 80, the cylinders 134 can either serve as hydraulic dampers or be replaced by commercially available hydraulic dampers. Using the conventional swing cylinders 134 as dampers is done either by installing one or more restrictive orifices in each of the piston heads of the cylinders 134 or by interconnecting the two extreme ends of each cylinder cavity of the individual cylinder bodies 135 by means of a connecting line having an in-line restrictive orifice. Either of these approaches provides the functional equivalent of a commercially available hydraulic damper.

OPERATION OF THE INVENTION

The operation of the tubing injector support system 80 of the coiled tubing rig 10 proceeds as described below. The trailer 20 supporting the coiled tubing rig is delivered to the well location in the configuration shown in both FIGS. 1 and 2. Typically, the tractor rig used for towing the coiled tubing rig 10 would be attached throughout the job, but the tractor is not shown herein for reasons of clarity.

To begin the job setup, the trailer 20 is backed up towards the drilling rig so that the midplane of the trailer 20 intersects the vertical axis of the well. When the trailer 20 is in its approximate position for swinging the intermediate frame assembly 110 with its injector cradle 81 and injector 50 up onto the rig floor 160, the jacks 28 supporting the trailer 20 are set to bear against the ground surface 18 so that the trailer is stabilized. Following this, the control room module 48 is elevated to its working position and the operator occupies the control room. The lift cylinders 134 are extended then by the coiled tubing rig operator so that the intermediate frame 110 is swung upwardly and towards the rig floor 160.

While the intermediate frame 110 is being raised or lowered by the lift cylinders 134, the clamp assembly 90 on the injector cradle 81 is used to clamp and immobilize the free end 72 of the tubing string 70. The operation of the clamp assembly 90 is discussed in the material below. During lifting of the tubing injector support system 80, the storage reel 40 is allowed to freewheel so that the tubing 70 is tensioned only by reel turning friction between the reel and the injector 50. During lowering of the tubing injector support system 80, the reel 40 is rotated so that excess tubing length between the reel and the injector 50 is retrieved onto the reel.

The length of the swing arms 126 and 127 is preselected to ensure that the intermediate frame 110 can reach the rig floor 160. After the swing arms 126 and 127 pass vertical, the intermediate frame 110 is lowered so that it rests on the rig floor. Counterbalance valves are used in the hydraulic control circuit for the lift cylinders 134 to prevent the sudden dropping of the tubing injector support system 80 when that system is being lowered in either direction.

If the free end 72 of the coiled tubing string 70 is not concentric with the well bore, the error is measured, the intermediate frame assembly 110 is lowered, the jacks 28 raised, and the trailer is moved to correct the trailer placement error. The jacks 28 are again lowered and the intermediate frame assembly 110 is again elevated so that the free end 72 of the coiled tubing string 70 can be entered coaxially into the well. The injector 50 can then be used to insert tubing 70 into or retract it from the well.

In the event that the tubing string 71 in the well becomes stuck or it is being used to pull a packer from the well, then it can be necessary to exert more tension on the tubing than can be provided by the rotational drive means of the injector 50. In such a case, the following procedure is used.

Figure 10:
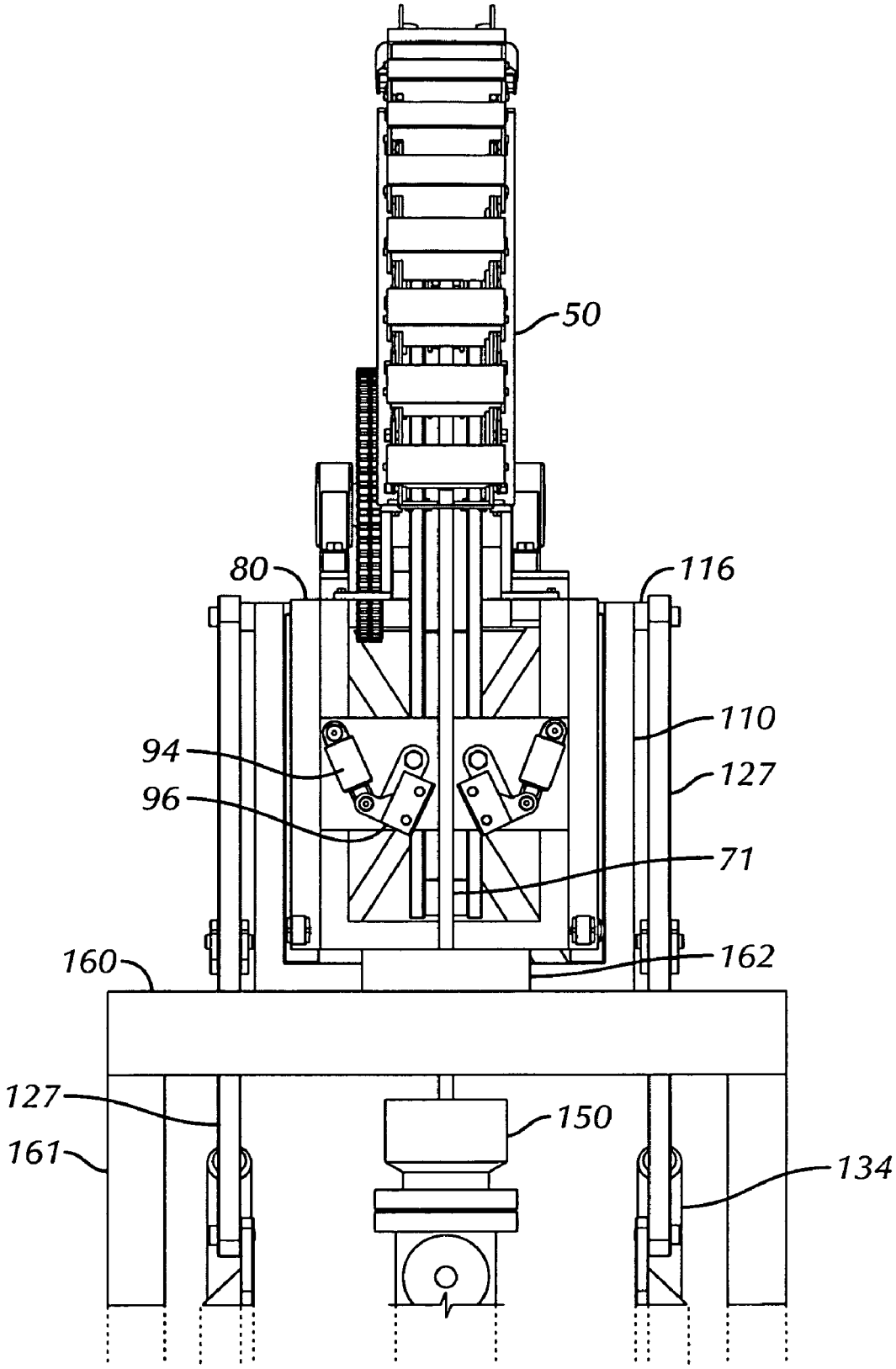
FIG. 10 is a view towards the front of the trailer showing the tubing injector in place on the rig floor of the drilling platform, wherein the coiled tubing is shown deployed into a well and the tubing is not gripped by the coiled tubing clamp assembly.
Figure 11:
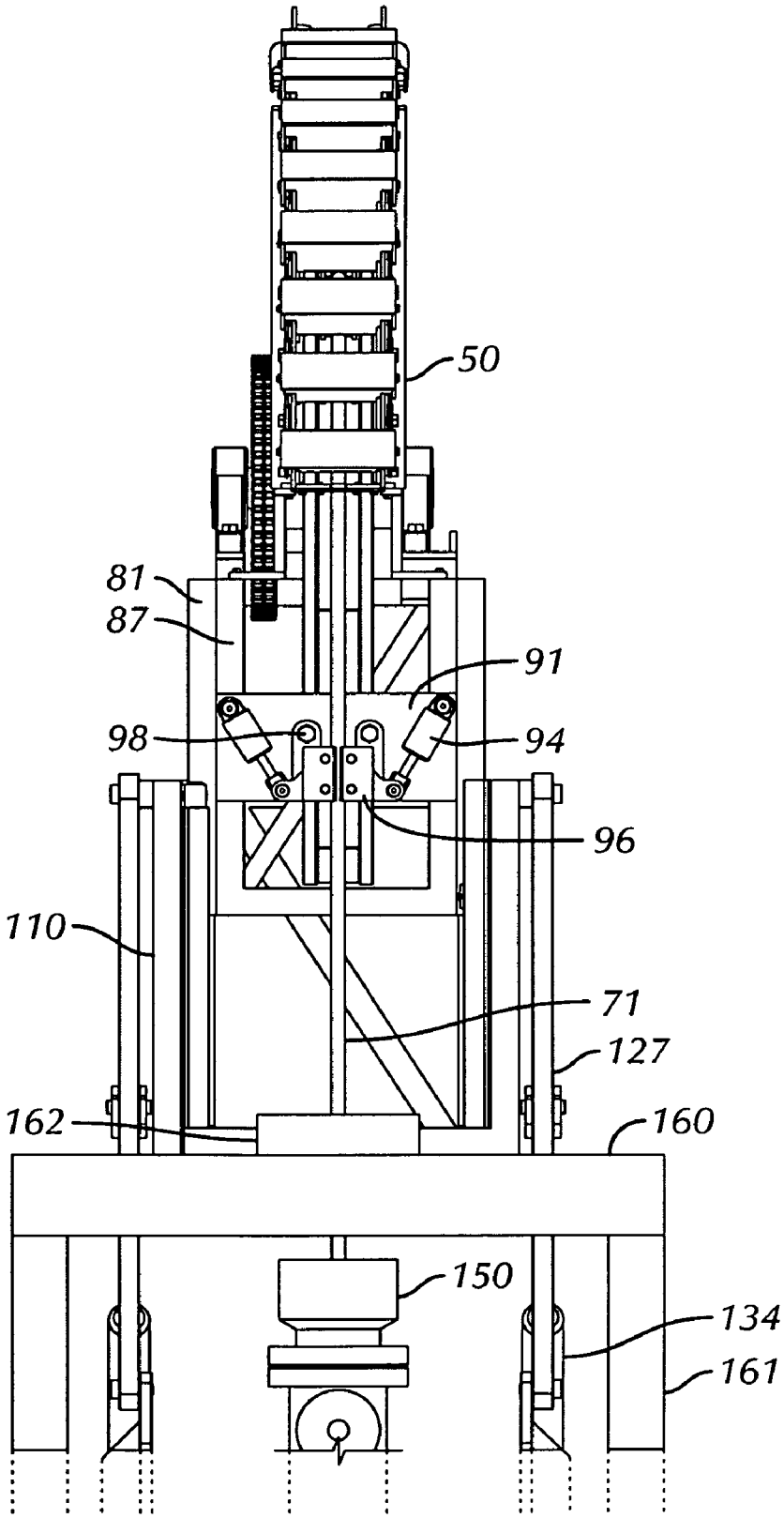
FIG. 11 corresponds to FIG. 10, but shows the gripping blocks of the coiled tubing clamp assembly biased against the tubing and the injector mounted in its cradle elevated relative to the intermediate frame and the rig floor in order to stretch or pull the tubing upwardly from the well.

The initial, lower position of the injector cradle 81 relative to the intermediate frame 110 is shown in FIG. 10. First, the tubing is clamped by extending the previously retracted clamp cylinders 94 of the clamp assembly 90 of the injector cradle 81 so that the clamp support blocks 96 supporting the grip blocks 97 are rotated about their clamp support block pins 98. The extension of the clamp cylinders 94 is continued until the tubing section 71 between the drive wheel 55 of the injector 50 and the blowout preventer 150 is firmly gripped between the grip blocks 97. The positions of the components of the clamp assembly 90 when clamping are shown in FIG. 11.

When the tubing section 71 deployed into the well is gripped at its upper end, then pressurized hydraulic fluid is directed to extend the four lift cylinders 84 by a selectably operable four-way three-position closed-center control valve. The longitudinal restraint roller assemblies 89 and 119 and the lateral restraint roller assemblies 88 and 118 centralize the injector cradle 81 within the intermediate frame 110 during raising and lowering. This raising of the injector cradle 81 with its clamped integral clamp assembly 90 gripping the upper end of the clamped tubing produces additional tension in the tubing section 71. FIG. 11 shows the injector cradle 81 in its position when fully raised by the lift cylinders 84.

In the event that this additional tension is insufficient to free the tubing or the packer, standard oilfield coiled tubing slips (not shown) can be used to hold the tubing 71 temporarily at the rotary table 162 while the clamp assembly 90 is released from the tubing 71 by retracting the clamp cylinders 94. The injector cradle 81 then can be lowered by the lift cylinders 84 preparatory to reclamping the tubing 71 for another lifting cycle to further tension the tubing 71. If the tubing section 71 is freed, then the injector cradle 81 can be lowered while the injector 50 and the tubing reel are rotated to retrieve the slack in the tubing. Further operations of the coiled tubing rig are then free to proceed as necessary.

When the job is complete, all of the tubing section 71 is pulled from the well and the clamp assembly is used to clamp the free end 72 of the tubing string 70. The tubing injector support system 80 can then be lowered to the rear deck 21 of the trailer 20 by retracting the swing cylinders 134 while the storage reel 40 is rotated to retrieve the excess tubing 70 between reel and the injector 50. The jacks 28 for the trailer of the coiled tubing rig 10 are then raised and the control room 48 lowered to its travel position. At this point, the coiled tubing rig is again roadworthy.

Alternatively, the swing cylinders 134 with restrictive orifices (or the equivalent commercially available hydraulic dampers) only provide motion damping when the tubing injector support system 80 is raised or lowered by cooperative manipulation of the tubing reel 40 and a lifting line 169 dependent from the crown block assembly 166 of the rig mast 164.

To raise the tubing injector support system 80 using the lifting line 169, the following steps replace the use of the hydraulic pressure to extend the lift cylinders 134. A lifting line 169 controlled by the drilling rig drawworks 165 and dependent from the crown block assembly 166 of the drilling rig mast is attached to the spreader bar 170. The spreader rods 171 at the ends of the spreader bar 170 are attached to the lifting eyes 100 of the injector cradle 81 of the injector support system 80 while the lift cylinders 84 are held in their retracted positions.

With the clamp assembly 90 gripping the tubing end 72, the tubing injector support system 80 is then raised from the rear deck 21 of the trailer 20 by reeling on the lifting line 169 while the tubing reel is allowed to freewheel. When the swing arms 126 and 127 are vertical, then additional tension on the tubing 70 between the reel 40 and the injector 50 is provided by braking the reel. The resulting lateral force in the forward direction on the tubing injector support system 80 is controlled by the coiled tubing rig operator so that the intermediate frame 110 of the injector support system will not impact the rig floor 160. The restraint on the motion of the tubing injector support system 80 provided by the damping of the swing cylinders 134 further aids the controlled lowering of the intermediate frame 110 to the rig floor 160. This allows the coiled tubing injector 50 to be emplaced on the rig floor 160 so that coiled tubing operations can begin following disconnection of the spreader bar 170 with its spreader rods 171 and spreader bar clevis pins 172.

To lower the tubing injector support system to the rear deck 21 of the trailer 20 for transport upon job completion, the following steps are used. The lifting line 169 with its spreader bar 170 and spreader rods 171 and spreader bar clevis pins 172 is reattached to the lifting eyes 100 of the injector cradle 81. With the end 72 of the tubing string 70 rigidly held by the clamp assembly 90 of the injector cradle 81, the storage reel 40 is rotated to initiate additional retrieval of the tubing 70. This initially pulls the swing arms 126, 127 towards a vertical position.

As the swing arms 126, 127 approach vertical, the slack in the lifting line 169 is taken up so that the tubing injector support system 80 will not fall to the rear deck 21 of the trailer 20 after the swing arms pass their vertical position. The hydraulic damping action provided by the swing cylinders 134 further aids avoidance of the dropping of the injector support system 80 after the swing arms 126, 127 pass vertical during the lowering operation. The slowing of the lowering operation thus permits the tubing storage reel 40 to take up excess slack in the tubing 70 between the reel and the injector 50.

ADVANTAGES OF THE INVENTION

The moveable tubing injector support assembly 80 is a self-contained means and apparatus for operating a coiled tubing rig either with its tubing injector located on the deck at the rear of its trailer in the conventional manner or operating the tubing injector on the rig floor of a drilling rig.

It is operationally much more convenient to have integral, rapidly operable means for both transferring and operating the coiled tubing injector either in its conventional position on the rear deck of the rig trailer or on the rig floor of a drilling rig. This saves operating time when the injector is to be transferred to and from a drilling rig floor and may avoid the need for providing a separate lifting means such as a crane or large forklift truck to effect the transfer. The transfer between the trailer and the drilling rig floor is easily accomplished with the self-contained lifting system shown in FIG. 3.

The second means of transferring the coiled tubing injector between the trailer and the rig floor of a drilling rig uses routinely available drilling rig equipment as a lifting means. Since the drilling rig lifting means is always available, this second lifting means is almost as easy to use as the hydraulic cylinders. Normally, hydraulic dampers do not need to be as large and expensive as the large hydraulic swing cylinders which would be needed to transfer the injector between the trailer and the drilling rig floor.

In addition, the lifting of the tubing injector support system between a first and second position provide can be used to induce additional tension in a coiled tubing string deployed into a well beyond that commonly available using only the coiled tubing injector. This novel feature is useful in the event that either the tubing has become stuck in the well or the tubing string is being used to unseat a packer or shift a downhole valve. These and other advantages of the present invention are readily recognizable by those skilled in the art.

Although the present invention and its advantages have been described in detail, it should be understood that various changes, substitutions and alterations can be made herein without departing from the spirit and scope of the invention as defined by the appended claims. For example, the configuration of various elements and/or the structure of the individual elements of the selectably elevatable coiled tubing injector can be varied without departing from the spirit of the invention.

What is claimed is:

1. A system for positioning a trailer mounted coiled tubing injector, the system comprising:

a trailer mounted coiled tubing injector, a positioning mechanism comprising:

(a) a coiled tubing injector support system including an injector cradle providing a framework for mounting the coiled tubing injector, wherein the injector cradle has a cradle opening wherein a portion of a drive wheel of the coiled tubing injector is rotatably housed, a frame assembly having a frame opening, wherein the injector cradle is nested within the frame opening, and a lifting mechanism for selectably elevating and lowering the injector cradle and the coiled tubing injector within the frame opening;

(b) a selectably engageable coiled tubing clamp assembly mounted on a first end of the frame assembly, wherein the coiled tubing clamp assembly includes a pair of grip blocks with each block selectably rotatable about a pivot pin to bias against a coiled tubing, and a pair of clamp cylinders, wherein each clamp cylinder is used to rotate one grip block; and (c) a swing arm assembly including a plurality of hinged support arms, wherein each support arm is attached at one end to the frame assembly and at a second end to a trailer, and a rotation device that reciprocably rotates the coiled tubing injector support system between a stowed position on the trailer and an operating position.

2. The positioning mechanism of claim 1, wherein the coiled tubing injector includes a radially acting coiled tubing hold down mechanism.

3. The positioning mechanism of claim 2, wherein whenever the injector cradle is nested in the frame opening the radially acting coiled tubing hold down mechanism is positioned above the injector cradle and the frame assembly.

4. The positioning mechanism of claim 2, wherein a coiled tubing first passes between the drive wheel and the radially acting coiled tubing hold down mechanism and then through the coiled tubing clamp assembly.

5. The positioning mechanism of claim 4, wherein whenever the coiled tubing support system is in the operating position a bottom side of the frame assembly is positioned on a rig floor such that the coiled tubing exiting the coiled tubing clamp assembly is concentric with a well bore.

6. The positioning mechanism of claim 1, wherein the rotation device includes a pair of lift cylinders.

7. The positioning mechanism of claim 6, wherein the rotation device further includes a pair of counterbalance valves.

8. A positioning mechanism for a trailer mounted coiled tubing injector, the positioning mechanism comprising:

(a) a coiled tubing injector support system including an injector cradle providing a framework for mounting the coiled tubing injector, wherein the injector cradle has a cradle opening wherein a portion of a drive wheel of the coiled tubing injector is rotatably housed, a frame assembly having a frame opening, wherein the injector cradle is nested within the frame opening, and a lifting mechanism for selectably elevating and lowering the injector cradle and the coiled tubing injector within the frame opening;

(b) a selectably engageable coiled tubing clamp assembly mounted on a first end of the frame assembly; and (c) a swing arm assembly including a plurality of hinged support arms, wherein each support arm is attached at one end to the frame assembly and at a second end to a trailer, and a rotation device that reciprocably rotates the coiled tubing injector support system between a stowed position on the trailer and an operating position, wherein a bottom side of the frame assembly is parallel to the trailer in both the stowed position and the operating position.

9. The positioning mechanism of claim 8, wherein the lifting mechanism is a plurality of hydraulic cylinders that elevate the injector cradle within the frame opening to a first cradle position and lower the injector cradle within the frame opening to a second cradle position.

10. The positioning mechanism of claim 8, wherein the coiled tubing clamp assembly includes a pair of grip blocks, each block selectably rotatable about a pivot pin to bias against a coiled tubing.

11. The positioning mechanism of claim 10, wherein the coiled tubing clamp assembly further includes a pair of clamp cylinders, wherein each clamp cylinder is used to rotate one grip block.

12. The positioning mechanism of claim 8, wherein the support arms remain parallel to each other when the coiled tubing injector system is rotated between the stowed position and the operating position.

13. A positioning mechanism for a trailer mounted coiled tubing injector system, the positioning mechanism comprising:

(a) a coiled tubing injector support system mounted on a trailer, the injector support system including a coiled tubing injector having a rotatable drive wheel and a radially acting coiled tubing hold down mechanism, an injector cradle providing a framework for mounting the coiled tubing injector, wherein the injector cradle has a cradle opening on a top side and wherein a portion of the drive wheel of the coiled tubing injector is rotatably housed and the radially acting coiled tubing hold down mechanism sits above the injector cradle, a frame assembly having a frame opening on a top side, wherein the injector cradle is nested within the frame opening such that the drive wheel of the coiled tubing injector remains rotatable within the injector cradle and the radially acting coiled tubing hold down mechanism sits above the frame assembly, and a lifting mechanism for selectably elevating or lowering the injector cradle and the coiled tubing injector within the frame opening, wherein a first end of the lifting mechanism is attached to the injector cradle and a second end of the lifting mechanism is attached to the frame assembly;

(b) a coiled tubing clamp assembly mounted on a first end of the frame assembly, wherein the coiled tubing clamp assembly has two grip blocks for selectably gripping a coiled tubing exiting the coiled tubing hold down mechanism, wherein each grip block of the coiled tubing clamp assembly is selectably rotatable about a pivot pin to bias each block against the coiled tubing such that when the two grip blocks are biased against opposed sides of the coiled tubing the grip blocks grip the tubing, and a pair of clamp cylinders, wherein each clamp cylinder is used to rotate one grip block; and (c) a swing arm assembly including a plurality of hinged support arms, wherein each support arm is attached at one end to the frame assembly and at a second end to the trailer, and a rotation device that reciprocably rotates the support arms thereby moving the coiled tubing injector support system into a stowed position on the trailer or to an operating position.

14. The positioning mechanism of claim 13, wherein the lifting mechanism is a plurality of hydraulic cylinders that elevate the injector cradle within the frame opening to a first cradle position and lower the injector cradle within the frame opening to a second cradle position.

15. A positioning mechanism for a trailer mounted coiled tubing injector system, the positioning mechanism comprising:

(a) a coiled tubing injector support system mounted on a trailer, the injector support system including a coiled tubing injector having a rotatable drive wheel and a radially acting coiled tubing hold down mechanism, an injector cradle providing a framework for mounting the coiled tubing injector, wherein the injector cradle has a cradle opening on a top side and wherein a portion of the drive wheel of the coiled tubing injector is rotatably housed and the radially acting coiled tubing hold down mechanism sits above the injector cradle, a frame assembly having a frame opening on a top side, wherein the injector cradle is nested within the frame opening such that the drive wheel of the coiled tubing injector remains rotatable within the injector cradle and the radially acting coiled tubing hold down mechanism sits above the frame assembly, and a lifting mechanism for selectably elevating or lowering the injector cradle and the coiled tubing injector within the frame opening, wherein a first end of the lifting mechanism is attached to the injector cradle and a second end of the lifting mechanism is attached to the frame assembly;

(b) a coiled tubing clamp assembly mounted on a first end of the frame assembly, wherein the coiled tubing clamp assembly has two grip blocks for selectably gripping a coiled tubing exiting the coiled tubing hold down mechanism; and (c) a swing arm assembly including a plurality of hinged support arms, wherein each support arm is attached at one end to the frame assembly and at a second end to the trailer, and a rotation device that reciprocably rotates the support arms thereby moving the coiled tubing injector support system into a stowed position on the trailer or to an operating position, wherein a bottom side of the frame assembly is parallel to the trailer in both the stowed position and the operating position.

16. The positioning mechanism of claim 15, wherein each grip block of the coiled tubing clamp assembly is selectably rotatable about a pivot pin to bias each block against the coiled tubing such that when the two grip blocks are biased against opposed sides of the coiled tubing the grip blocks grip the tubing.

17. The positioning mechanism of claim 16, wherein the coiled tubing clamp assembly further includes a pair of clamp cylinders, wherein each clamp cylinder is used to rotate one grip block.

18. The positioning mechanism of claim 15, wherein the rotation device includes a pair of lift cylinders.

19. The positioning mechanism of claim 18, wherein the rotation device further includes a pair of counterbalance valves.

20. The positioning mechanism of claim 15, wherein the support arms remain parallel to each other when the coiled tubing support system is rotated between the stowed position and the operating position.

21. The positioning mechanism of claim 15, wherein whenever the coiled tubing support system is in the operating position a bottom side of the frame assembly is positioned on a rig floor such that the coiled tubing exiting the coiled tubing clamp assembly is concentric with a well bore.

* * * * *